US011594100B2

(12) United States Patent
Bond et al.

(10) Patent No.: US 11,594,100 B2
(45) Date of Patent: Feb. 28, 2023

(54) CASINO FLOOR SERVICE MANAGEMENT SYSTEM AND METHOD

(71) Applicant: IGT, Las Vegas, NV (US)

(72) Inventors: Eugene Bond, Trabuco Canyon, CA (US); Gandalf Hudlow, San Marcos, CA (US); Jie Zhou, Beijing (CN); Lu Zhao, Beijing (CN); Naibin Song, Beijing (CN); Hua Cheng, Beijing (CN); Guangzhuang Xie, Beijing (CN); Wei Yan, Beijing (CN); Wei Gong, Beijing (CN)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/917,341

(22) Filed: Jun. 30, 2020

(65) Prior Publication Data

US 2021/0012611 A1 Jan. 14, 2021

Related U.S. Application Data

(63) Continuation of application No. 14/833,924, filed on Aug. 24, 2015, now abandoned.

(60) Provisional application No. 62/056,155, filed on Sep. 26, 2014.

(51) Int. Cl.
*G07F 17/32* (2006.01)

(52) U.S. Cl.
CPC ..... *G07F 17/3232* (2013.01); *G07F 17/3234* (2013.01); *G07F 17/3241* (2013.01)

(58) Field of Classification Search
CPC ..... G07F 17/3232; G07F 17/3234
See application file for complete search history.

(56) References Cited

U.S. PATENT DOCUMENTS 5,111,391 A 5/1992 Fields et al.
5,613,912 A 3/1997 Slater et al.
5,655,961 A 8/1997 Acres et al.
5,678,015 A 10/1997 Goh et al.
(Continued)

FOREIGN PATENT DOCUMENTS

EP 1209604 A2 * 5/2002 ..... G06Q 10/0631

*Primary Examiner* — David L Lewis
*Assistant Examiner* — Robert E Mosser
(74) *Attorney, Agent, or Firm* — Neal, Gerber & Eisenberg LLP

(57) ABSTRACT

Various embodiments of the present disclosure provide a casino floor service management system and method that integrates with a casino management system of a casino and leverages the knowledge and experience of casino floor service management system users, such as technicians, floor attendants, and hostesses, to efficiently resolve service floor events in a timely manner. Generally, the casino floor service management system of the present disclosure is configured to: (1) receive notifications from the casino management system when floor events occur, (2) automatically distinguish between service floor events and non-service floor events, (3) automatically generate work items representing the service floor events and aggregate the work items into a dynamically-updated backlog, and (4) enable casino floor service management system users to interface with the casino floor service management system to personally choose which particular work items from the backlog the casino floor service management system users will resolve.

18 Claims, 25 Drawing Sheets

(56) References Cited

U.S. PATENT DOCUMENTS

| | | | |
|---|---|---|---|
| 5,729,673 | A | 3/1998 | Cooper et al. |
| 5,762,552 | A | 6/1998 | Vuong et al. |
| 5,971,271 | A | 10/1999 | Wynn et al. |
| 6,104,815 | A | 8/2000 | Alcorn et al. |
| 6,106,396 | A | 8/2000 | Alcorn et al. |
| 6,142,876 | A | 11/2000 | Cumbers et al. |
| 6,234,900 | B1 | 5/2001 | Cumbers |
| 6,424,264 | B1 | 7/2002 | Giraldin et al. |
| 6,460,848 | B1 | 10/2002 | Soltys et al. |
| 6,508,709 | B1 | 1/2003 | Karmarkar |
| 6,826,534 | B1 | 11/2004 | Gupta et al. |
| 6,884,170 | B2 | 4/2005 | Rowe |
| 6,887,157 | B2 | 5/2005 | LeMay et al. |
| 6,965,868 | B1 | 11/2005 | Bednarek |
| 7,300,352 | B2 | 11/2007 | Rowe |
| 7,957,565 | B1 | 6/2011 | Sharma et al. |
| 8,480,486 | B2 | 7/2013 | Friesen et al. |
| 2002/0087404 | A1 | 7/2002 | Silkey et al. |
| 2002/0152120 | A1 | 10/2002 | Howington |
| 2003/0032479 | A1 | 2/2003 | LeMay et al. |
| 2003/0195022 | A1 | 10/2003 | Lynch et al. |
| 2004/0024608 | A1 | 2/2004 | Saenz et al. |
| 2006/0053035 | A1 | 3/2006 | Eisenberg |
| 2007/0038570 | A1 | 2/2007 | Halbritter et al. |
| 2007/0174809 | A1 | 7/2007 | Brown et al. |
| 2008/0004996 | A1 | 1/2008 | Kuehling |
| 2008/0020788 | A1 | 1/2008 | Griswold et al. |
| 2008/0090645 | A1 | 4/2008 | Walker et al. |
| 2009/0239667 | A1 | 9/2009 | Rowe et al. |
| 2009/0284348 | A1 | 11/2009 | Pfeffer |
| 2009/0291762 | A1 | 11/2009 | Walker |
| 2010/0113161 | A1 | 5/2010 | Walker et al. |
| 2011/0071880 | A1 | 3/2011 | Spector |
| 2011/0205068 | A1 | 8/2011 | Huynh et al. |
| 2012/0094756 | A1 | 4/2012 | Griswold et al. |
| 2012/0150578 | A1 | 6/2012 | Mangat et al. |
| 2013/0190943 | A1 | 7/2013 | Wester |
| 2013/0275169 | A1 | 10/2013 | Acres |
| 2014/0100033 | A1 | 4/2014 | Walker et al. |
| 2014/0370989 | A1 | 12/2014 | Acres |

* cited by examiner

CASINO FLOOR SERVICE MANAGEMENT SYSTEM AND METHOD

PRIORITY CLAIM

This application is a continuation of, and claims priority to and the benefit of, U.S. patent application Ser. No. 14/833,924, which was filed Aug. 24, 2015 which is a continuation of, and claims priority to and benefit of U.S. Provisional Patent Application No. 62/056,155, which was filed on Sep. 26, 2014, which is now expired, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the U.S. Patent and Trademark Office patent file or records, but otherwise reserves all copyright rights whatsoever.

BACKGROUND

A typical casino (or other gaming establishment) includes hundreds or even thousands of electronic gaming machines (EGMs) spread out over the casino floor. Certain events that occur at these EGMs prevent operation of the EGMs and require the assistance of a casino employee to render the EGMs operational. For instance, when a casino patron playing at an EGM wins an award above a designated amount, the EGM prevents further play until a floor attendant travels to the EGM to verify the award and provide the casino patron with a hand payment. In another example, when a ticket printer of an EGM runs out of paper, the EGM prevents further play until a slot technician replaces the paper. In another example, when a component of the EGM fails (e.g., the bill acceptor or the display device stops working), the EGM prevents further play until a slot technician repairs or replaces the broken component. Other events that occur at these EGMs do not prevent operation of the EGMs, but nevertheless demand the assistance of a casino employee. For instance, when a casino patron presses the service button of an EGM, a floor attendant must travel to the EGM to determine what the casino patron desires. Other events that occur at these EGMs do not prevent operation of the EGMs or demand the assistance of a casino employee, but the casino desires employee involvement for other reasons. For example, when a VIP casino patron begins playing a high-denomination EGM, the casino may desire a floor attendant to welcome the VIP casino patron to the casino.

These types of events, referred to herein as service floor events, occur regularly at a casino that is open twenty-four hours a day, seven days a week; that includes hundreds or thousands of EGMs on the casino floor; and that services thousands or even tens of thousands of casino patrons daily. To provide the best possible experience for casino patrons and, in certain instances, to minimize EGM down-time, it is desirable for the casino to implement a casino floor service management system to quickly recognize when a service floor event occurs, to efficiently identify the appropriate casino employee(s) (or contractor(s) or other service provider(s)) to resolve that particular service floor event, and to dispatch the casino employee(s) (or contractor(s) or other service provider(s)) to resolve the service floor event.

One known way of implementing a casino floor service management system includes employing human dispatchers to: (1) monitor for the occurrence of service floor events; (2) when a service floor event occurs, identify the service floor event; (3) identify an available casino employee (or contractor or other service provider) who is able to resolve the service floor event; (4) contact the casino employee (or contractor or other service provider) (such as via radio or telephone), provide the casino employee (or contractor or other service provider) information regarding the service floor event, and instruct the casino employee (or contractor or other service provider) to resolve the service floor event; and (5) monitor the status of the casino employee's (or contractor's or other service provider's) progress throughout the resolution process.

This known way of using human dispatchers to implement a casino floor service management system is problematic for a variety of reasons. Using human dispatchers introduces human error into the process. For instance, the dispatcher may overlook a service floor event or instruct an unqualified casino employee (or contractor or other service provider) to resolve a service floor event. For example, if the dispatcher overlooks a casino patron winning a jackpot award that requires a hand payment, the casino patron may become frustrated and bored while waiting for a casino employee (or contractor or other service provider) to arrive and provide the hand payment, which ruins the casino patron's experience. In another example, if the dispatcher instructs an unqualified casino employee (or contractor or other service provider) to replace the paper in a ticket printer, the casino patron must wait for another, qualified casino employee (or contractor or other service provider) to arrive and replace the paper to enable the casino patron to continue play, which may also frustrate and bore the casino patron. Using human dispatchers is also labor intensive—the casino must employ enough dispatchers to deal with the hundreds or thousands of service floor events that occur daily in association with hundreds or thousands of EGMs operating around-the-clock. And even if the casino employs enough human dispatchers, it is difficult for the dispatchers to coordinate tens or hundreds of casino employees (or contractors or other service providers) to resolve hundreds or thousands of daily service floor events. Unless there is a constant line of communication between each dispatcher and each casino employee (or contractor or other service provider)—which is practically impossible for all intents and purposes—the dispatchers do not know exactly where in the casino the casino employees are located or what the casino employees (or contractors or other service providers) are doing at any particular point in time.

Another known way of implementing a casino floor service management system includes employing a computerized service floor event assignment system to: (1) monitor for the occurrence of service floor events; (2) when a service floor event occurs, automatically generate a task for that service floor event; (3) using a database of casino employees (or contractors or other service providers) and their predetermined attributes (e.g., type of employee (or contractor or other service provider) (such as hostess, floor attendant, or technician) and specialty (such as bill acceptor repair, display device repair, etc.)), automatically select a casino employee (or contractor or other service provider) to whom to assign the task; and (4) automatically assign the task to the selected casino employee (or contractor or other service provider), such as by sending a message to the casino employee's (or contractor's or other service provider's) mobile device.

This known way of using a computerized service floor event assignment system to implement a casino floor service management system is problematic for a variety of reasons. This known computerized service floor event assignment system simply selects a casino employee (or contractor or other service provider) to whom to assign a task based on predetermined rules and/or configurations, and thus lacks flexibility, especially when it comes to requesting and utilizing the knowledge and experience of the casino employees (or contractors or other service providers) themselves. Put differently, in many cases the casino employees (or contractors or other service providers) themselves are in the best position to assign tasks based on their knowledge and experience, the constantly changing context of the casino floor environment, the available resources and casino staff, and the like. The rigid rules of this known computerized service floor event assignment system do not take this into account. Further, this known computerized service floor event assignment system does not track or present casino employee (or contractor or other service provider) and service floor event location-based information in a user-friendly format. Additionally, this known computerized service floor event assignment system does not manage or utilize floor-event-based context information that provides additional information about the service floor events, such as photos, videos, or text-based descriptions. Finally, this known computerized service floor event assignment system typically only services a single casino rather than multiple casinos.

These problems are magnified when contractors or other service providers service multiple casinos in multiple different physical locations that are either commonly-owned or not commonly-owned.

A need exists for new and improved casino floor service management systems and methods that solve the above problems.

SUMMARY

Various embodiments of the present disclosure provide a casino floor service management system and method that integrates with a casino management system of a casino and leverages the knowledge and experience of casino floor service management system users, such as technicians, floor attendants, and hostesses, to efficiently resolve service floor events in a timely manner. Generally, the casino floor service management system of the present disclosure is configured to: (1) receive indications or notifications from the casino management system of the casino when floor events occur, (2) automatically distinguish between service floor events and non-service floor events, (3) automatically generate work items representing the service floor events and aggregate the work items into a dynamically-updated backlog, and (4) enable casino floor service management system users to interface with the casino floor service management system to personally choose which particular work items from the backlog the casino floor service management system users will resolve.

The casino floor service management system of the present disclosure solves the above-described problems. The casino floor service management system of the present disclosure does not employ human dispatchers, and thus avoids the human error caused by human dispatchers and reduces any associated labor costs. Further, the casino floor service management system of the present disclosure is configured to seamlessly communicate with hundreds or thousands of EGMs and mobile devices to generate, maintain, and dynamically update a backlog of work items representing all service floor events requiring resolution, thus ensuring that casino floor service management system users receive updates in real-time to keep them as informed and coordinated as possible.

Additionally, the casino floor service management system of the present disclosure is flexible and relies on the knowledge and experience of the casino floor service management system users themselves in enabling the casino floor service management system users to personally choose which particular work items that they will to resolve rather than automatically assigning tasks based on predetermined, inflexible rules. Further, the casino floor service management system of the present disclosure presents casino floor service management system user and service floor event locations in any of a variety of different a user-friendly formats. Additionally, the casino floor service management system of the present disclosure enables casino floor service management system users to input floor-event-based context information that provides additional details about the service floor events. Further, certain embodiments of the casino floor service management system of the present disclosure may service multiple casinos at once.

Additional features and advantages are described herein, and will be apparent from, the following Detailed Description and the Figures.

BRIEF DESCRIPTION OF THE FIGURES

FIGS. 2A, 2B, 2C, 2D, 2E, 2F, 2G, 2H, 2I, 2J, 2K, 2L, 2M, 2N, 2O, 2P, 2Q, and 2R are screenshots of a variety of different interfaces of a mobile device of the casino floor service management system of the present disclosure.

DETAILED DESCRIPTION

Figure 1:
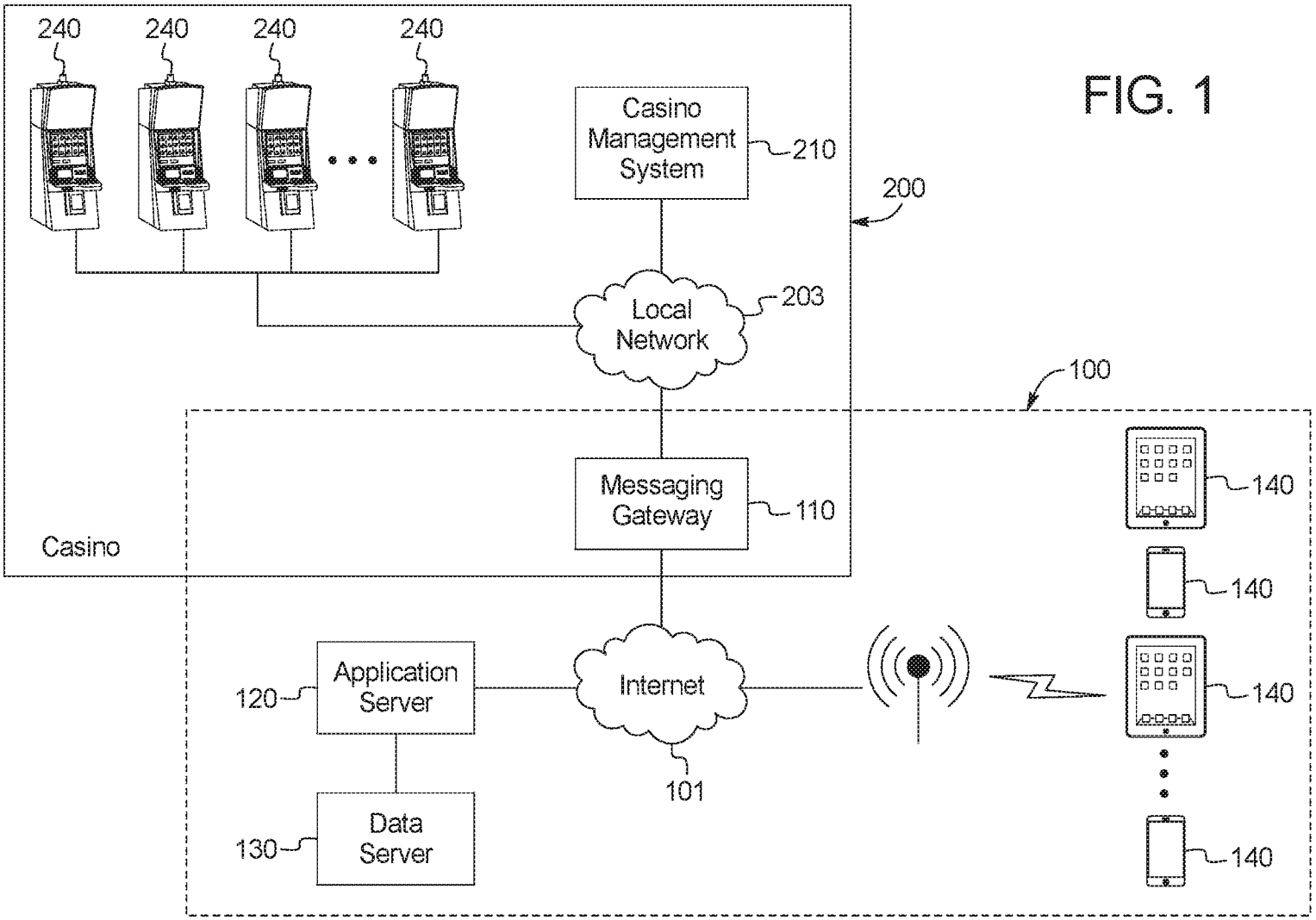
FIG. 1 is a block diagram of one embodiment of the casino floor service management system of the present disclosure.

As described above, a typical casino (or other gaming establishment) includes hundreds or thousands of EGMs that are configured to communicate with and exchange information with a casino management system (CMS) of a casino over a suitable network, such as an private intranet or the Internet. While in operation, the EGMs are configured to monitor for the occurrence of any of a plurality of different floor events and, when one of the plurality of different floor events occurs, transmit an indication of the occurrence of that particular floor event to the CMS. The plurality of different floor events may include any suitable events established by the casino (such as events that are considered important to the casino or otherwise notable), and include:

(1) non-service floor events that do not require resolution or involvement by a casino floor service management system user; and (2) service floor events that require resolution or involvement by the casino floor service management system user, such as (but not limited to): (i) events that occur at EGMs that prevent operation of the EGMs; (ii) events that occur at EGMs that do not prevent operation of the EGMs, but that nevertheless demand the assistance of a casino floor service management system user; and/or (iii) events that occur at EGMs that do not prevent operation of the EGMs or demand the assistance of a casino floor service management system user, but for which the casino desires casino floor service management system user involvement.

In various embodiments, the service floor events include one or more of, but are not limited to: (1) a casino patron wins an award that requires a hand payment; (2) a ticket printer of an EGM runs out of paper; (3) a bill acceptor of an EGM receives a counterfeit bill or a counterfeit ticket; (4) a component of an EGM stops functioning (e.g., a display device breaks, a physical button sticks, a touch screen stops working, etc.); (5) an EGM loses its network connection; (6) an EGM loses power; (7) a bill acceptor of an EGM is full; (8) a VIP casino patron inserts his player tracking card into an EGM; (9) a casino patron having a relatively high level in the casino's player tracking system inserts her player tracking card into an EGM; (10) an EGM receives a service request from a casino patron; (11) an EGM receives a food or beverage request from a casino patron; (12) a casino patron has been playing at an EGM for at least a designated amount of time; (13) a casino patron has won at least a designated amount of money while playing an EGM; (14) a casino patron has lost at least a designated amount of money while playing an EGM; (15) a casino patron wins a designated monetary award; (16) a casino patron wins a designated non-monetary award; (17) a notable event occurs for a casino patron (e.g., it's the casino patron's birthday); (18) an EGM recognizes a cheating casino patron; (19) a general tilt condition occurs; (20) a player tracking card inserted into an EGM has been abandoned; (21) an EGM determines that a ticket has been rejected a designated quantity of times; (22) an EGM determines that a player tracking card has been rejected a designated quantity of times; (23) an EGM determines that a player tracking card has not been inserted; and/or (24) an EGM detects software failure.

In certain embodiments, the non-service floor events include one or more of, but are not limited to: (1) an EGM recognizes that a bill has been inserted into the bill acceptor; (2) an EGM recognizes that a ticket has been inserted into the bill acceptor; (3) an EGM recognizes that its door has been opened; and/or (4) an EGM prints a ticket.

Casino Floor Service Management System

Various embodiments of the present disclosure provide a casino floor service management system that integrates with the CMS of the casino and leverages the knowledge and experience of casino floor service management system users to efficiently resolve service floor events in a timely manner. Generally, the casino floor service management system is configured to: (1) receive indications or notifications from the CMS when floor events occur, (2) automatically distinguish between service floor events and non-service floor events, (3) automatically generate work items representing the service floor events and aggregate the work items into a dynamically-updated backlog, and (4) enable casino floor service management system users to interface with the casino floor service management system to personally choose which particular work items from the backlog the casino floor service management system user will to resolve. The casino floor service management system of the present disclosure thus enables the users themselves to evaluate a particular work item and determine if they are in the appropriate location to resolve that work item, have the appropriate tools to resolve that work item, have the appropriate supplies to resolve that work item, and have the appropriate training and expertise to resolve that work item, thus being in a position to most effectively and efficiently resolve that work item, before choosing to resolve that work item.

It should be appreciated that the casino floor service management system users may be any suitable persons such as, but not limited to: (1) hosts or hostesses, (2) concierges, (3) floor attendants, (4) pit bosses, (5) waiters and waitresses, (6) restaurant workers, (7) technicians, (8) floor managers, and/or (9) supervisors. It should also be appreciated that the users may be employed by any suitable entity, such as, but not limited to: (1) the casino; (2) a third-party contractor; and/or (3) a third-party service provider.

1. Casino Floor Service Management System Components

FIG. 1 illustrates one embodiment of the casino floor service management system of the present disclosure, which is generally indicated by numeral 100. The casino floor service management system 100 includes: (a) a messaging gateway 110, (b) an application server 120, (c) a data server 130, and (d) a plurality of mobile devices 140. The messaging gateway 110 and the application server 120 are configured to communicate with one another over a suitable wired or wireless network, such as the Internet 101 or a private intranet. The application server 120 and the data server 130 are configured to communicate with one another over a suitable wired or wireless network. The application server 120 and the mobile devices 140 are configured to communicate with one another over a suitable wireless network, such as the Internet 101 or a private intranet.

In this embodiment, the casino floor service management system 100 is employed to facilitate the resolution of service floor events for a plurality of EGMs 240 of a casino 200. The casino 200 includes a CMS 210 configured to communicate with the EGMs 240 over a suitable wired or wireless network, such as the casino's local network 203. The messaging gateway 110 of the casino floor service management system 100 and the CMS 210 are configured to communicate with one another over the casino's local network 203.

1.1 Messaging Gateway

The messaging gateway 110 is configured to act as an intermediary between the CMS 210 and the application server 120, and is configured to control which information transmitted from the CMS 210 reaches the application server 120. More specifically, the messaging gateway 110 is configured to: (1) receive information transmitted from the CMS 210; (2) filter out undesired information (e.g., information associated with non-service floor events); (3) convert the remaining desired information into a format usable by the application server 120 (if necessary); and (4) transmit the remaining desired information to the application server 120 (in the appropriate format).

The messaging gateway 110 may receive a variety of information from the CMS 210. In various embodiments, the messaging gateway 110 is configured to receive, from the CMS 210, all indications or notifications of occurrences of floor events at the EGMs 240. In certain embodiments, the messaging gateway 110 is configured to receive, from the CMS 210, indications or notifications that an EGM has received a casino floor service management system user identification card and indications that the casino floor service management system user identification card has been removed from the EGM. In certain embodiments, the messaging gateway 110 is configured to receive, from the CMS 210, information associated with the player of the EGM for which the floor event occurred. In various embodiments, the messaging gateway 110 is configured to receive, from the CMS 210, location information associated with the floor event (e.g., the location of the EGM at which the floor event occurred); priority information associated with the floor event (e.g., the floor event is a "HIGH" priority floor event); information associated with a player associated with the floor event (e.g., the information about the player whose player tracking card is inserted into the EGM at which the floor event occurred); and/or information associated with the EGM (if any) at which the floor event occurred.

The messaging gateway 110 examines the received information and filters out undesired information. Put differently, the messaging gateway 110 separates desired information from undesired information. For instance, in various embodiments in which the messaging gateway 110 receives all indications of occurrences of floor events at the EGMs 240, the messaging gateway 110 filters out the indications of occurrences of non-service floor events before relaying the remaining indications of occurrences of service floor events to the application server 120.

If necessary, the messaging gateway 110 converts the remaining desired information to be transmitted to the application server 120 into a format usable by the application server 120. For instance, in various embodiments, the messaging gateway 110 converts the received indication of an occurrence of a service floor event into a standardized casino floor service message representing that particular service floor event, which is a format usable by the application server 120.

The messaging gateway may transmit the remaining desired information to the application server 120 in any suitable manner, such as over any suitable network.

1.2 Application Server

The application server 120 is configured to: (1) generate work items representing the service floor events that have occurred at the EGMs 240; (2) maintain and dynamically update a backlog of the work items as casino floor service management system users select work items from the backlog, indicate that they are in the process of resolving the work items, and indicate that they have resolved the work items; and (3) make the backlog available to the mobile devices 140. In other words, the application server 120 generates work items, maintains the information related to the work items, and controls the information disseminated to the mobile devices 140.

The application server 120 is configured to receive any suitable information, including: (1) information related to a new occurrence of a service floor event for which the application server 120 has not yet generated a work item, such as (but not limited to) one or more of: (a) the location of the service floor event (e.g., at EGM #0179, at Blackjack table #15, at the front desk, at a particular location on the casino floor unrelated to an EGM, and the like); (b) the type of service floor event (e.g., bill acceptor broken, touch screen not responsive, casino patron won a jackpot requiring a hand payment, and the like); (c) the date and time at which the service floor event occurred; (d) information about a player associated with the service floor event (e.g., the player's name, the player's player tracking level, the player's age, and the like); and (e) an image of the player associated with the service floor event; and (2) information related to an existing work item such as (but not limited to) one or more of: (a) a change in status of the work item (e.g., the casino floor service management system user is in the process of resolving the work item, the casino floor service management system user has resolved the work item, the casino floor service management user has discarded the work item, the casino floor service management user has escalated the work item, and the like); (b) work item context information (e.g., an image, a video, or text); (c) information associated with the particular casino floor service management system user who selected to resolve the work item; (d) the time at which that casino floor service management system user began resolving the work item; (e) the location of the casino floor service management system user who has selected to resolve the work item; (f) the time at which that casino floor service management system user resolved the work item; and (g) player feedback on the quality of resolution of the work item (e.g., the player was happy with how quickly the work item was resolved).

After receiving information related to a new occurrence of a service floor event for which the application server 120 has not yet generated a work item, the application server 120 generates a work item for that occurrence of the service floor event. The application server associates a variety of information with the work item such as (but not limited to): (a) the location of the service floor event (e.g., at EGM #0179); (b) the type of service floor event (e.g., bill acceptor broken); (c) the date and time at which the service floor event occurred (e.g., Sep. 22, 2014 at 5:20 AM); (d) information about a player associated with the service floor event (e.g., Evelyn Hannon, a Gold Level player, is currently logged into EGM #0179); (e) a priority level (e.g., Priority Level #2); (f) the status of the work item (e.g., "OPEN," since the work item has just been created); and/or (g) the frequency of occurrence of a designated event that gave rise to the service floor event (e.g., the bill acceptor rejected a particular ticket five times in a row).

The application server 120 stores the newly-created work item in a backlog that includes active (i.e., non-resolved) work items and, in certain embodiments, certain resolved work items. Put differently, the application server 120 updates the backlog to include the newly-created work item. The application server 120 makes the updated backlog available to the mobile devices 140. In certain embodiments, the application server 120 actively transmits the updated backlog to the mobile devices 140, while in other embodiments the application server 120 enables the updated backlog to be downloaded by the mobile devices 140. Once the mobile devices 140 receive the updated backlog (either by receiving a transmission of the updated backlog from the application server 120 or by accessing and downloading the updated backlog), the casino floor service management system users can use the mobile devices 140 to browse the updated backlog, as described below.

After receiving information related to an existing work item, the application server 120 updates the work item by adding information associated with the work item, removing information associated with the work item, and/or modifying information associated with the work item. After doing so, the application server 120 updates the backlog to include the updated work item, and makes the updated backlog available to the mobile devices 140, as described above.

The application server 120 thus dynamically modifies the backlog of work items (such as by generating new work items and by modifying existing work items based on received information) on a regular basis to ensure that the backlog includes the most up-to-date information about the work items, which in turn ensures that the casino floor service management system users have access to the most up-to-date information about the work items when interfacing with the casino floor service management system.

In certain embodiments, before updating the backlog to include a newly-generated work item, the application server 120 ensures that the newly-generated work item is not a duplicate of an existing work item awaiting resolution. If the application server 120 determines that the newly-generated work item is a duplicate of an existing work item awaiting resolution, the application server 120 does not update the backlog to include the newly-generated work item.

The application server 120 includes one or more central servers, central controllers, or remote hosts. The application server 120 includes at least one processor and at least one memory device or storage device. The at least one processor is configured to transmit and receive data or signals representing events, messages, commands, or any other suitable information between the application server 120 and any other suitable devices, such as the messaging gateway 110 and the mobile devices 140. The at least one processor is configured to execute the events, messages, or commands represented by such data or signals in conjunction with the operation of the application server 120. In certain embodiments, computerized instructions for controlling operation of the application server 120 are stored in the at least one memory device and executed by the at least one processor. The application server 120 is configured to connect to a data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium.

1.3 Data Server

The data server 130 is configured to store data representing certain of the above-described information received by the application server 120 such that the application server 120 may access and retrieve such data.

The data server 130 includes one or more central servers, central controllers, or remote hosts. The data server 130 includes at least one processor and at least one memory device or storage device. The at least one processor is configured to transmit and receive data or signals representing events, messages, commands, or any other suitable information between the data server 130 and any other suitable devices, such as the application server 120. The at least one processor is configured to execute the events, messages, or commands represented by such data or signals in conjunction with the operation of the data server 130. In certain embodiments, computerized instructions for controlling operation of the data server 130 are stored in the at least one memory device and executed by the at least one processor. The data server 130 is configured to connect to a data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium.

1.4 Mobile Devices

The mobile devices 140 generally enable the casino floor service management system users to interface with the casino floor service management system 100. The mobile devices 140 include laptop computers, tablet computers or computing devices, personal digital assistants (PDAs), mobile telephones, and/or wearable electronic devices (such as "smart" watches). Each mobile device 140 includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). The at least one processor of the mobile device 140 is configured to communicate with, configured to access, and configured to exchange signals with at least one memory device or data storage device. In various embodiments, the at least one memory device of the mobile device 140 includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the mobile device 140 includes flash memory and/or EEPROM (electrically erasable programmable read only memory). It should be appreciated that any other suitable magnetic, optical, and/or semiconductor memory may operate in conjunction with the mobile device 140 disclosed herein.

In certain embodiments, the at least one memory device of the mobile device 140 stores program code and instructions executable by the at least one processor of the mobile device 140 to control the mobile device 140. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium.

In various embodiments, the mobile device 140 includes one or more input devices. The input devices may include any suitable device that enables an input signal to be produced and received by the at least one processor of the mobile device 140. In certain embodiments, one input device of the mobile device 140 is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the mobile device 140 by touching the touch screen at the appropriate locations.

In various embodiments, one input device of the mobile device 140 is a sensor, such as a camera, in communication with the at least one processor of the mobile device 140 (and controlled by the at least one processor of the mobile device 140 in some embodiments) and configured to acquire an image or a video.

In various embodiments, the mobile device 140 includes one or more output devices. One or more output devices of the mobile device 140 are one or more display devices. In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

In certain embodiments, one output device of the mobile device 140 is a sound generating device controlled by one or more sound cards. In one such embodiment, the sound generating device includes one or more speakers or other sound generating hardware and/or software for generating sounds.

Certain of the mobile devices 140 include an application installed thereon that enables the casino floor service management system users to interface with the casino service floor management system 100. Certain of the mobile devices 140 include a web browser that enables the casino floor service management system users to interface with the casino service floor management system 100.

Figure 2A:
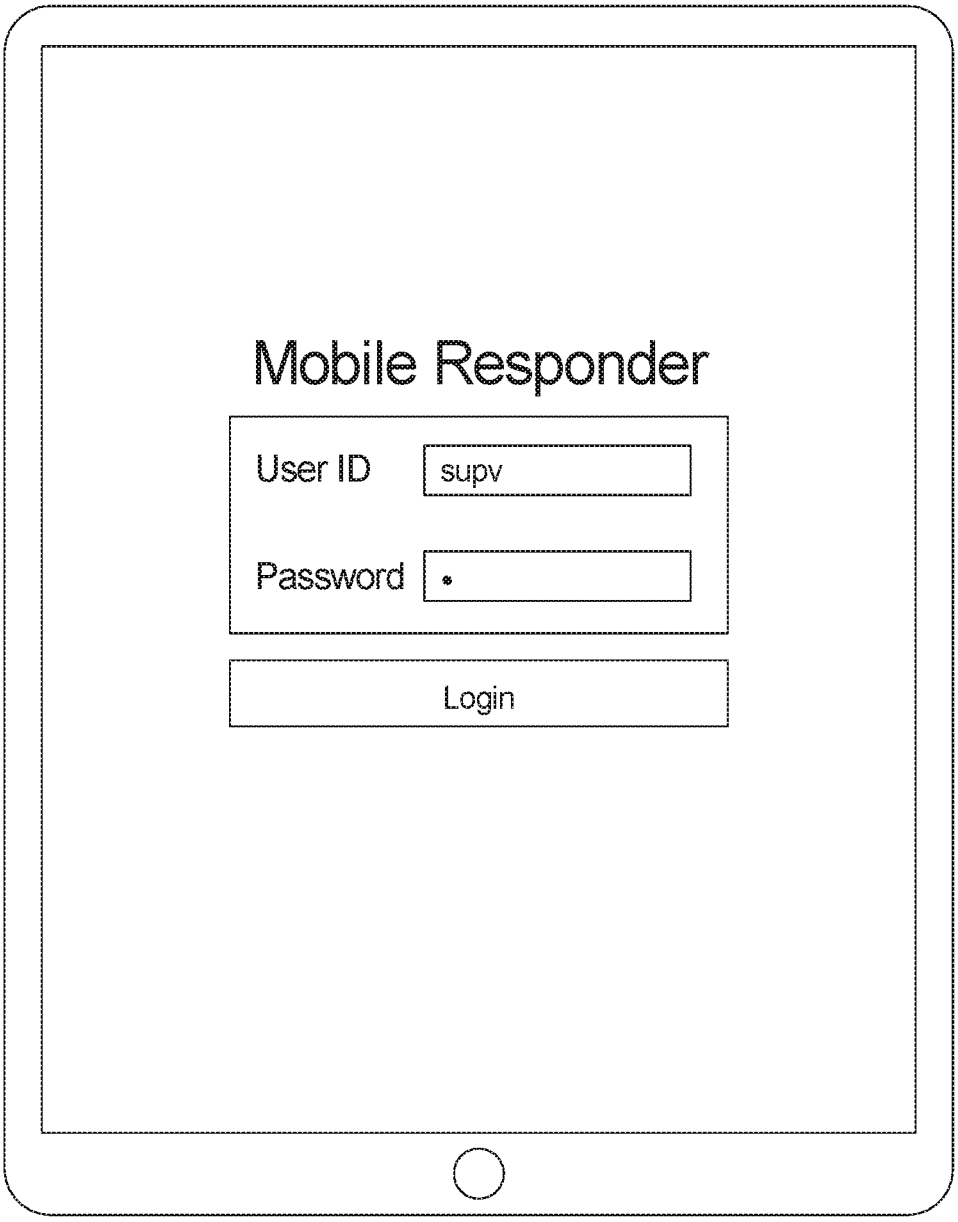

In various embodiments, before enabling a casino floor service management system user to interface with the casino floor service management system using a mobile device 140, the mobile device 140 requires the casino floor service management system user to verify her identity in any suitable manner, such as (but not limited to): (1) via input of a unique, corresponding username and password combination (FIG. 2A is a screenshot of a login screen requiring a casino floor service management system user to input a unique, corresponding username and password combination to before interfacing with the casino floor service management system 100); (2) via fingerprint verification; (3) via retinal scan verification; (4) via voice recognition verification; and/or (5) via QR code scan (e.g., via scanning a QR code on an employee badge).

As described above, the mobile device 140 either receives the backlog (and any subsequent updates thereto) transmitted from the application server 120 or accesses and downloads the backlog (and any subsequent updates thereto). The mobile device 140 enables the casino floor service management system user to visualize and manipulate the backlog according to the casino floor service management system user's personal preferences. In certain embodiments, the mobile device 140 enables the casino floor service management system user to filter or sort the backlog according to certain criteria, such as (but not limited to): (1) the status of the work item (e.g., "OPEN," "TAKEN," "IN PROGRESS," or "CLOSED"); (2) the distance of the work item location from the casino floor service management system user (e.g., within 50 feet; within 100 feet; within 300 feet; within 1,000 feet; or over 1,000 feet); (3) the type of work item (e.g., broken bill acceptor, unresponsive touch screen, hand payment required, and the like); (4) the priority of the work item (e.g., "HIGH," "MEDIUM," or "LOW"); (5) the time of creation of the work item (e.g., less than 1 hour ago, 1 to 2 hours ago, or more than 2 hours ago); (6) the type of casino floor service management system user desired or required to resolve the work item (e.g., casino host, floor attendant, or slot technician); (7) the casino section in which the work item is located; (8) the work items selected by a particular casino floor service management system user (e.g., "My Tasks" or "Bill Johnson's Tasks"); (9) the work items associated with a particular EGM; (10) the work items associated with a particular player; (11) the work items associated with a particular escalation status (e.g., the work items that have been escalated to "HIGH" priority); and/or (12) the work items related to a designated player feedback rating.

Figure 2B:
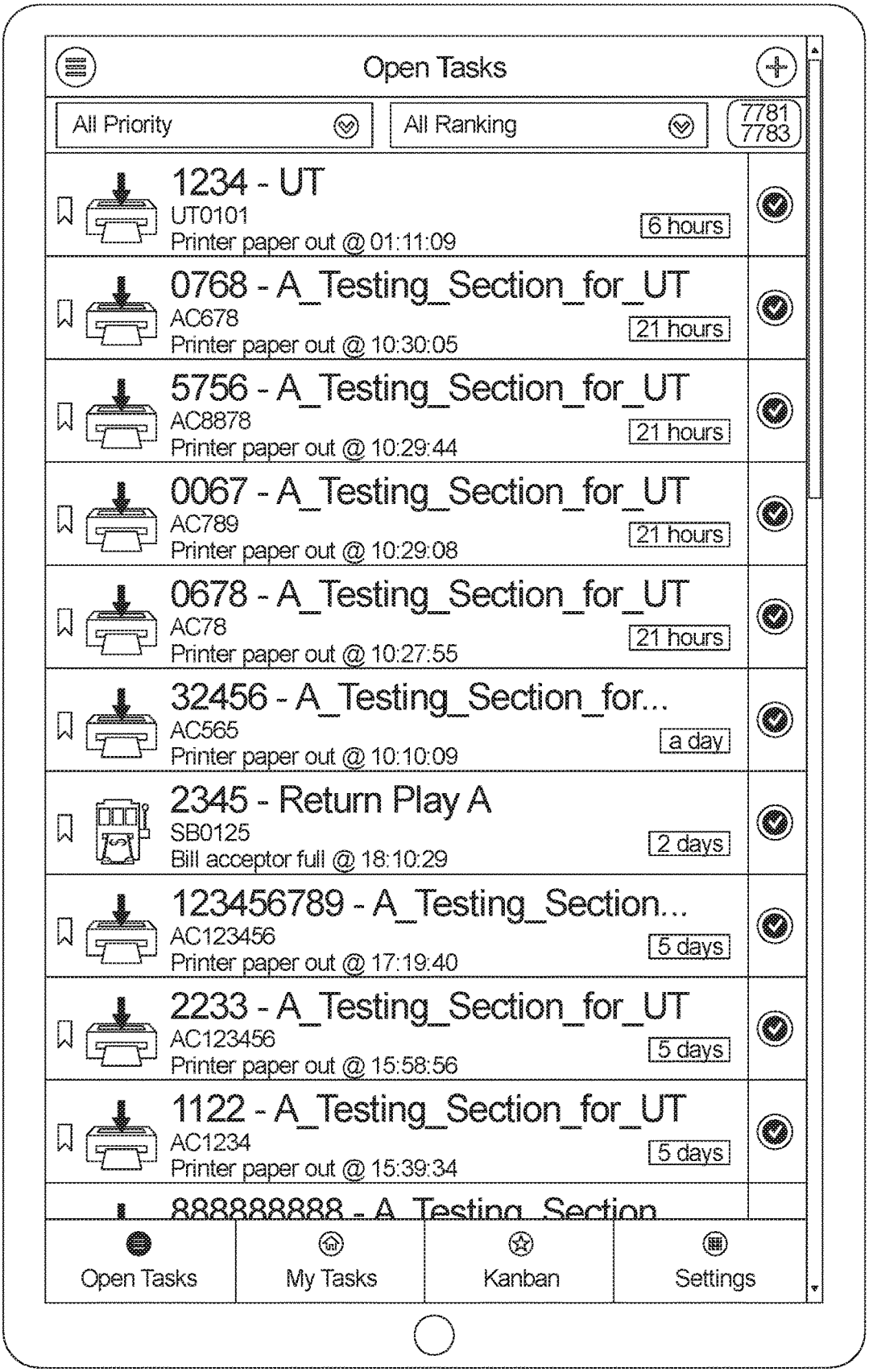
Figure 2C:
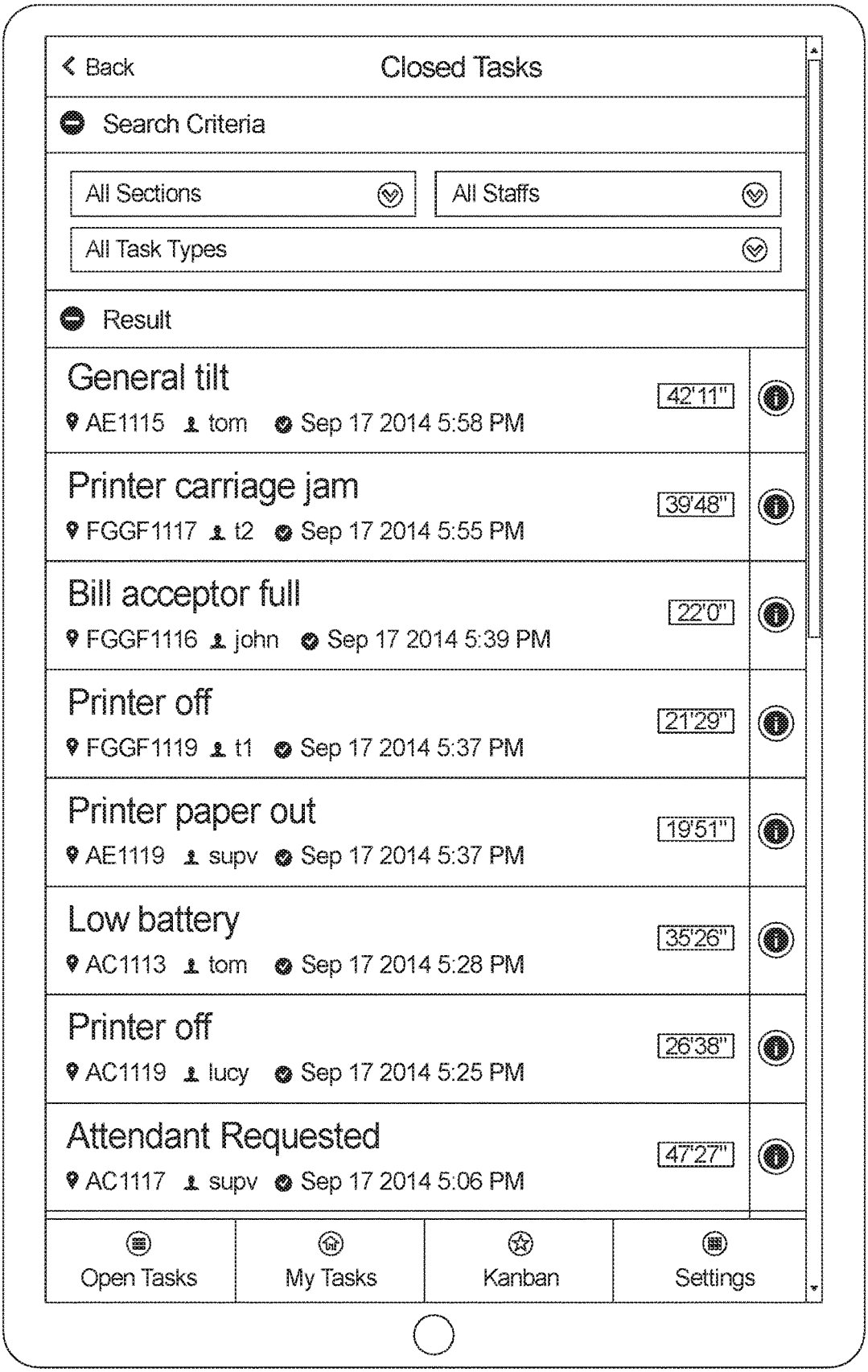
Figure 2D:
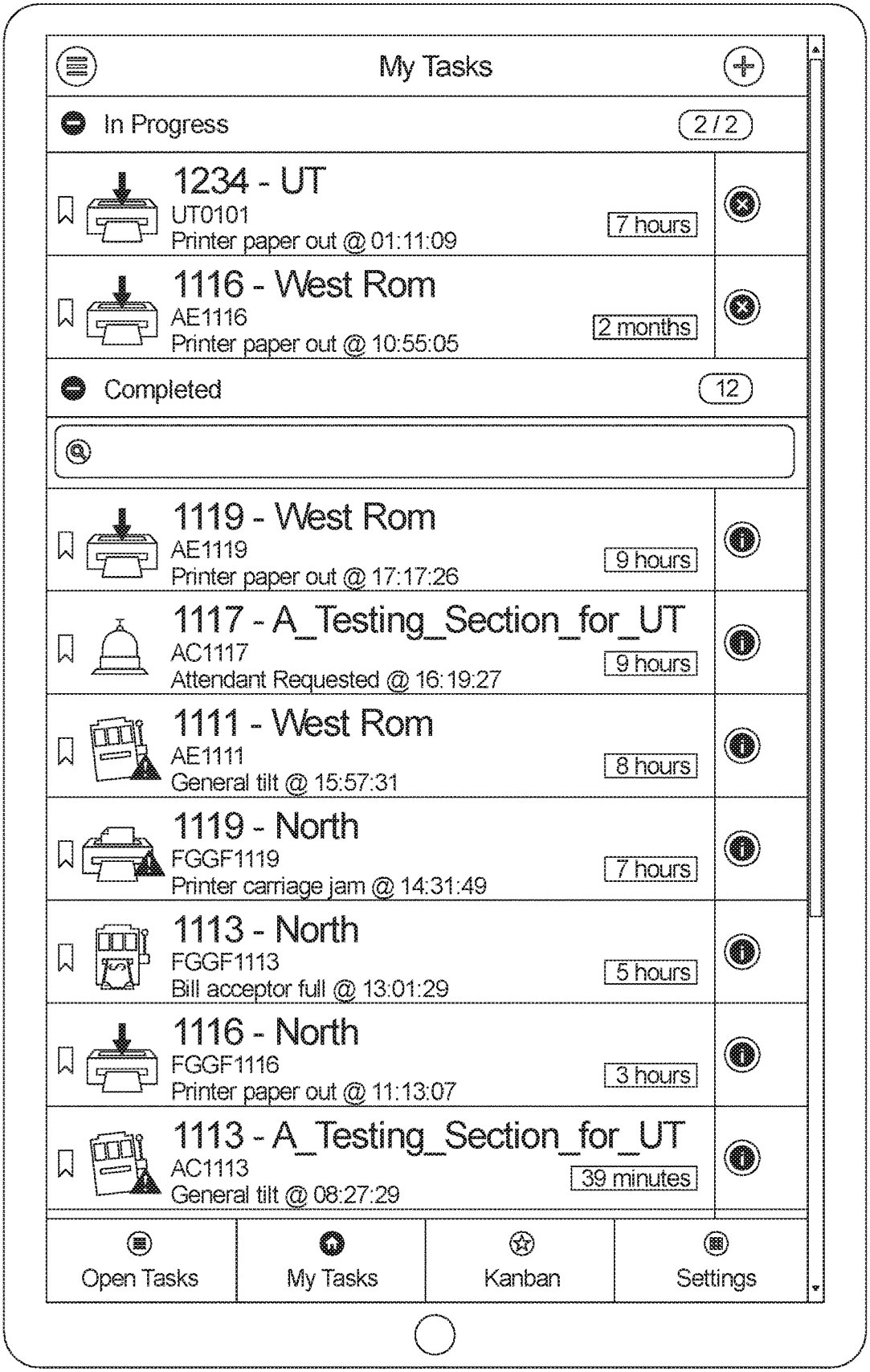
Figure 2E:
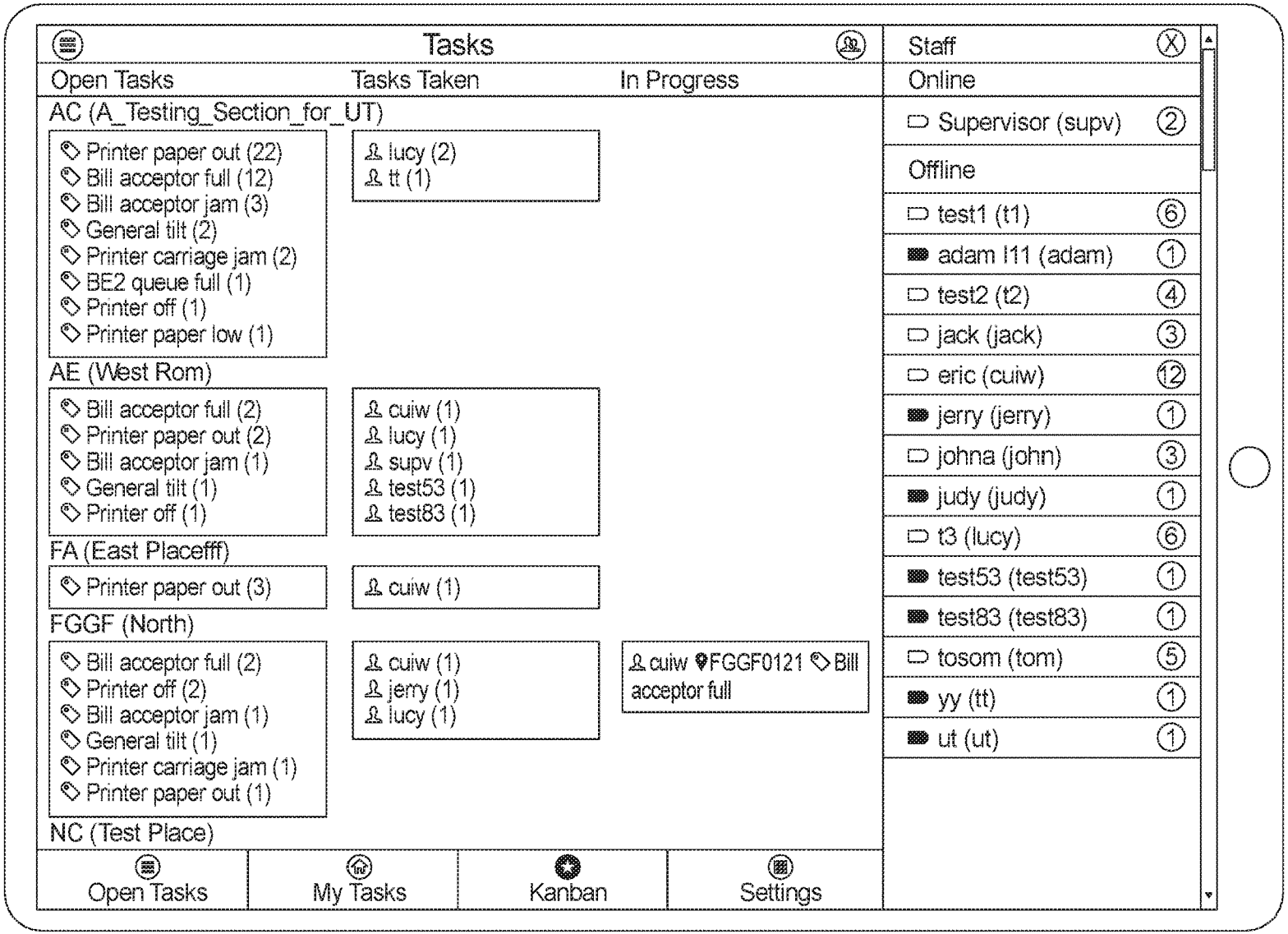
Figure 2F:
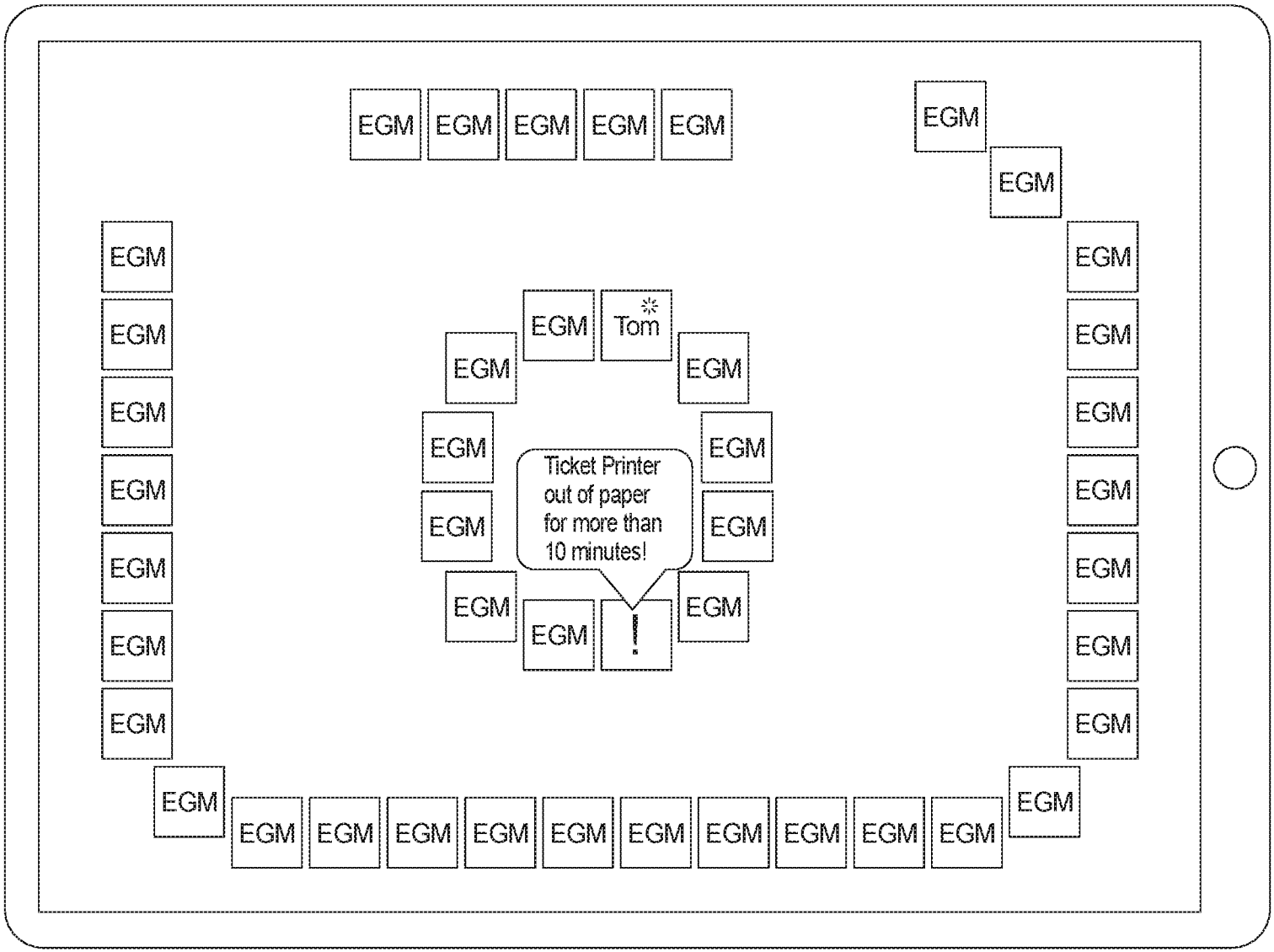

In various embodiments, the mobile device 140 enables the casino floor service management system user to visualize the backlog (or any suitable subset thereof, such as the casino floor service management system users selected work items) in a variety of different formats, such as (but not limited to): (1) a list format (FIGS. 2B, 2C, and 2D are screenshots of differently-filtered sets of work items in a list format); (2) a kanban board format (FIG. 2E is a screenshot of a set of work items in a kanban board format); (3) on a map of the casino floor (FIG. 2F is a screenshot of a map of the casino floor indicating the location of a casino floor service management system user (Tom) and the location of a work item); (4) a map of the casino floor showing a heatmap of work items (e.g., red areas represent areas with many work items and blue areas represent areas with few work items); and/or (5) a map of the casino floor showing a heatmap of player feedback.

Figure 2G:
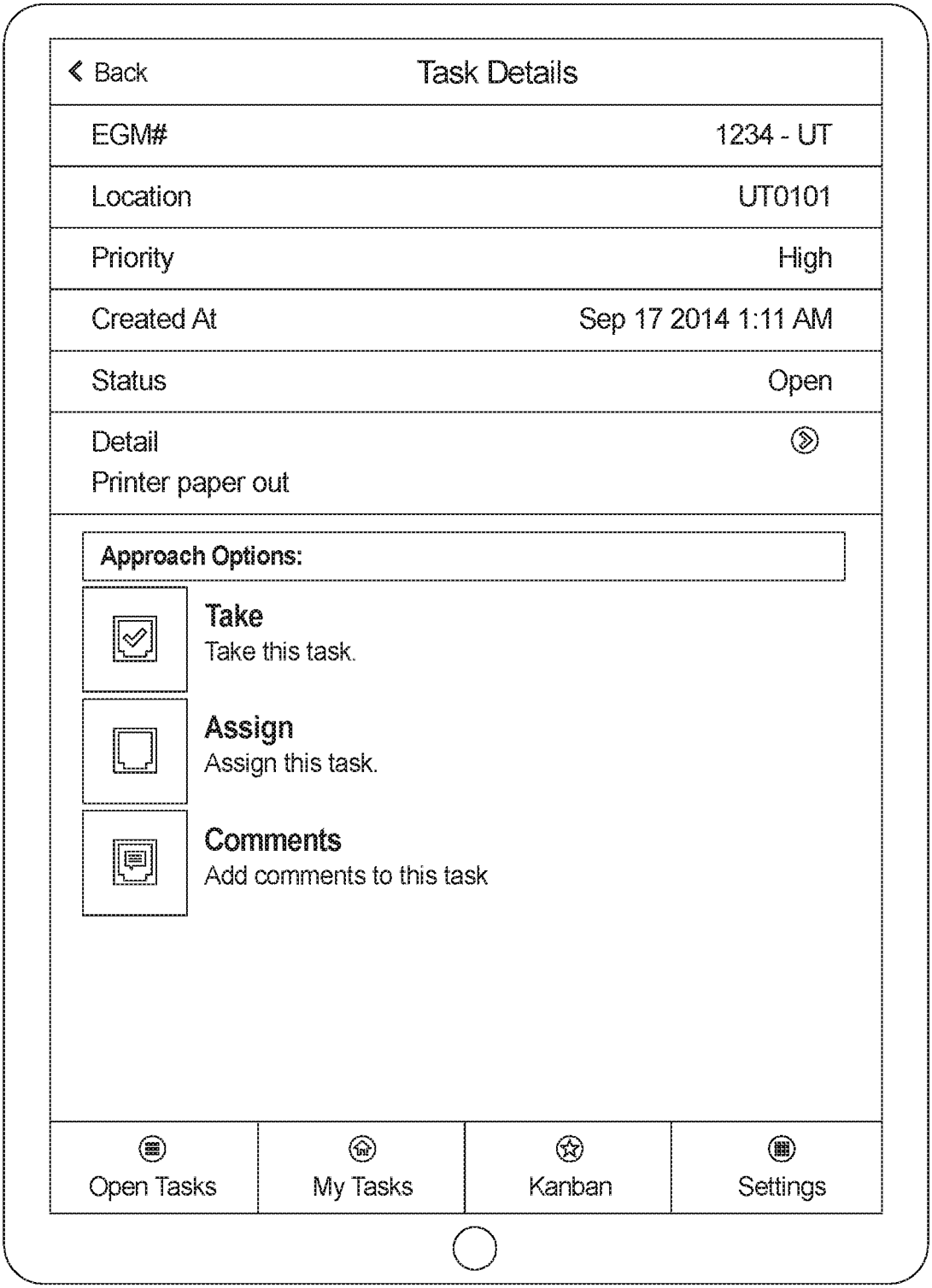
Figure 2H:
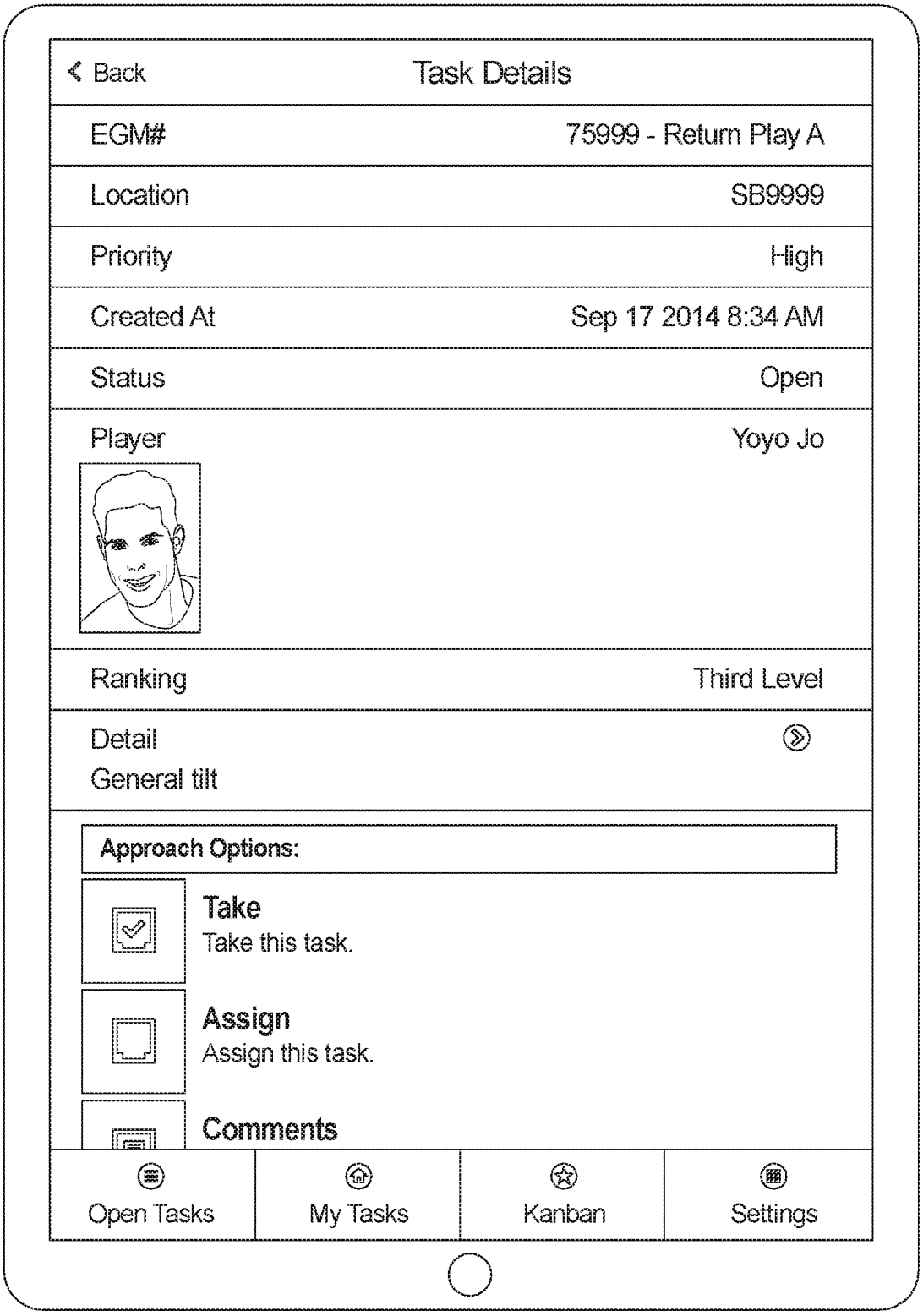
Figure 2I:
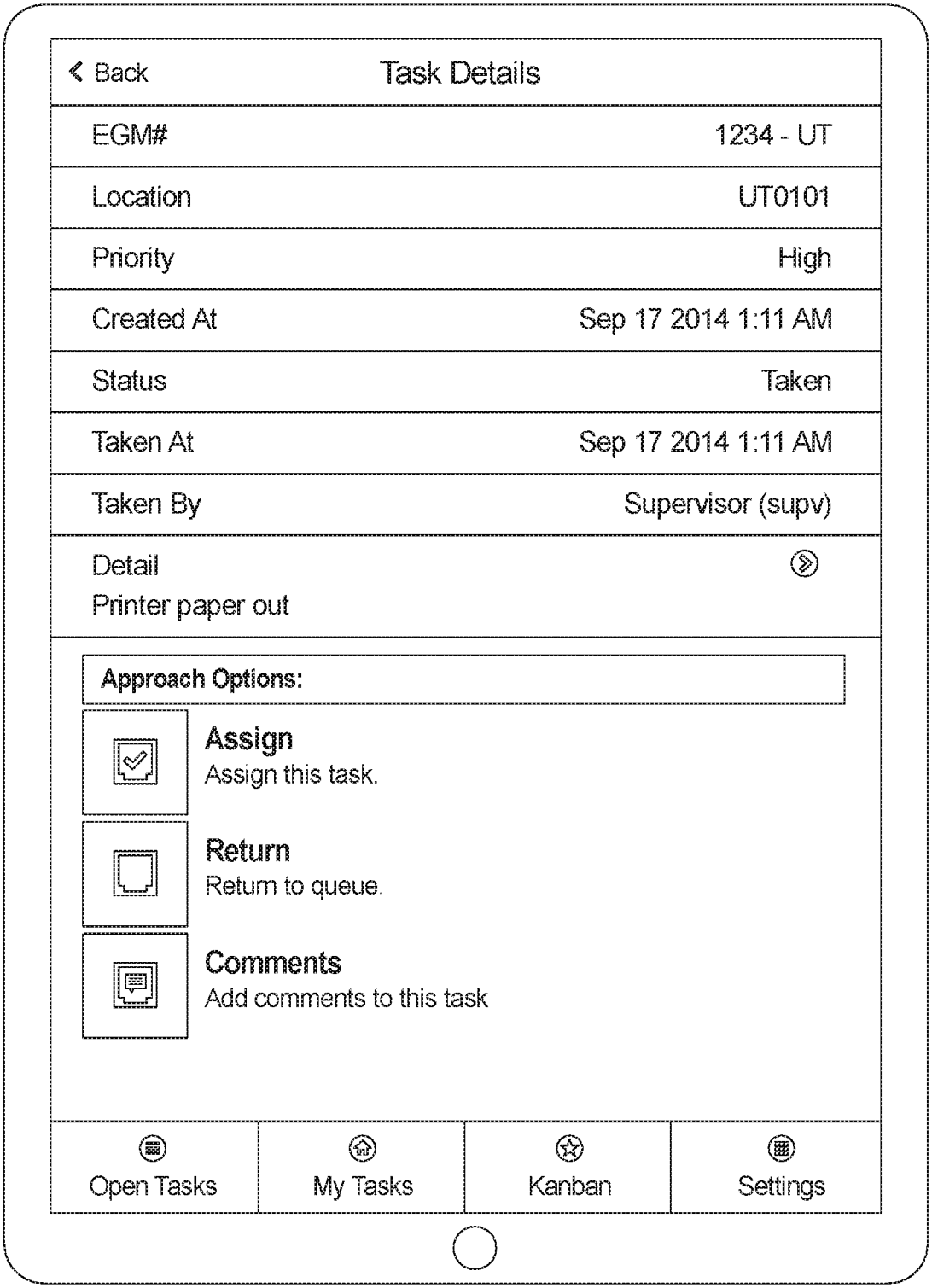
Figure 2J:
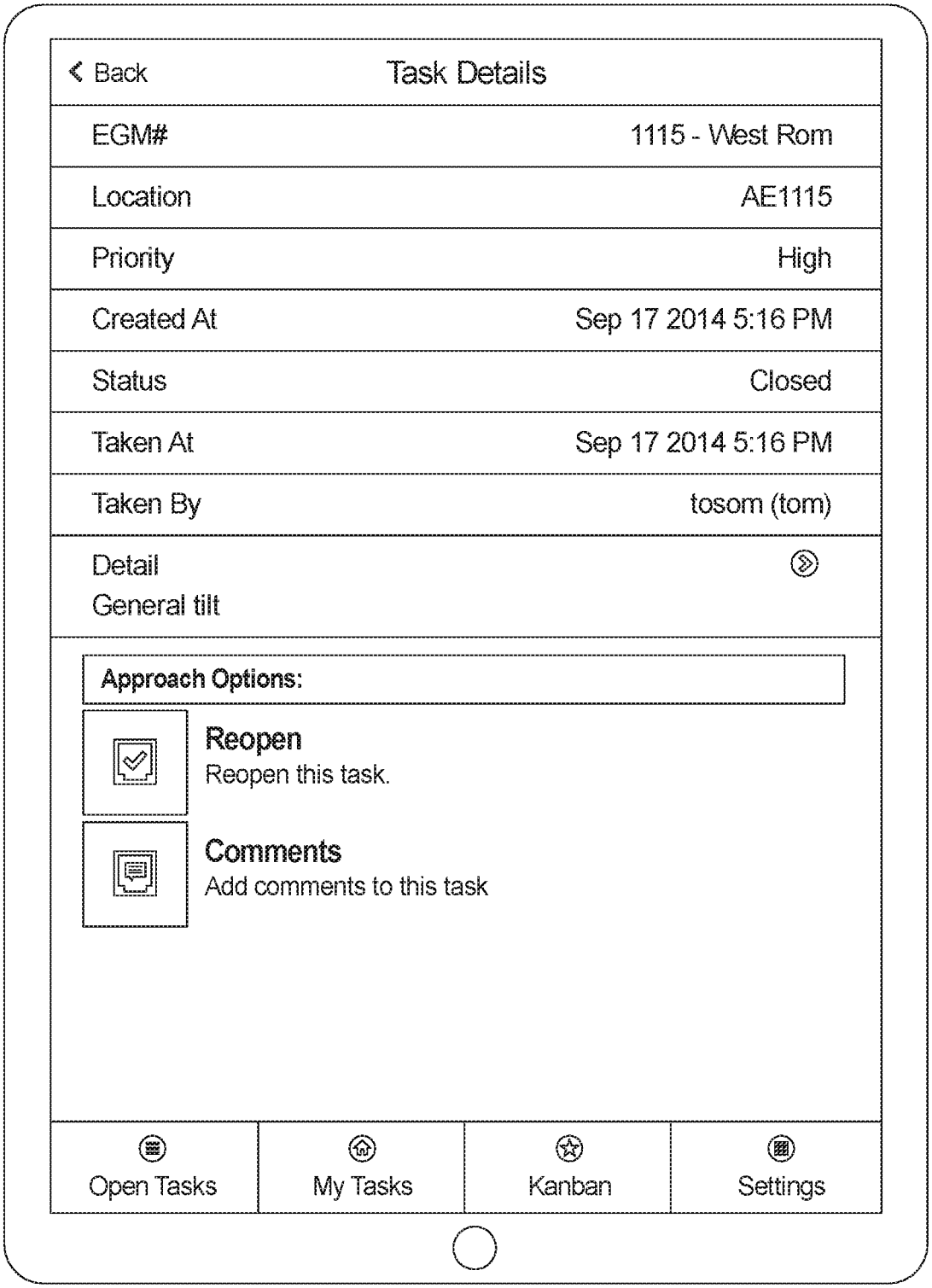

In various embodiments, the mobile device 140 enables a casino floor service management system user to view the information or details associated with each item. FIGS. 2G and 2H are screenshots of the details of two different "OPEN" work items. FIG. 2I is a screenshot of the details of a "TAKEN" work item. FIG. 2J is a screenshot of the details of a "CLOSED" work item.

In certain embodiments, the mobile device 140 enables a casino floor service management system user to select items that the casino floor service management system user desires to resolve. As noted above, once the mobile device 140 receives a selection of a work item that the casino floor service management system user desires to resolve, the mobile device 140 transmits an indication of that selected work item to the application server 120 over the Internet 101 to enable the application server 120 to update the status of that work item and the backlog.

Figure 2K:
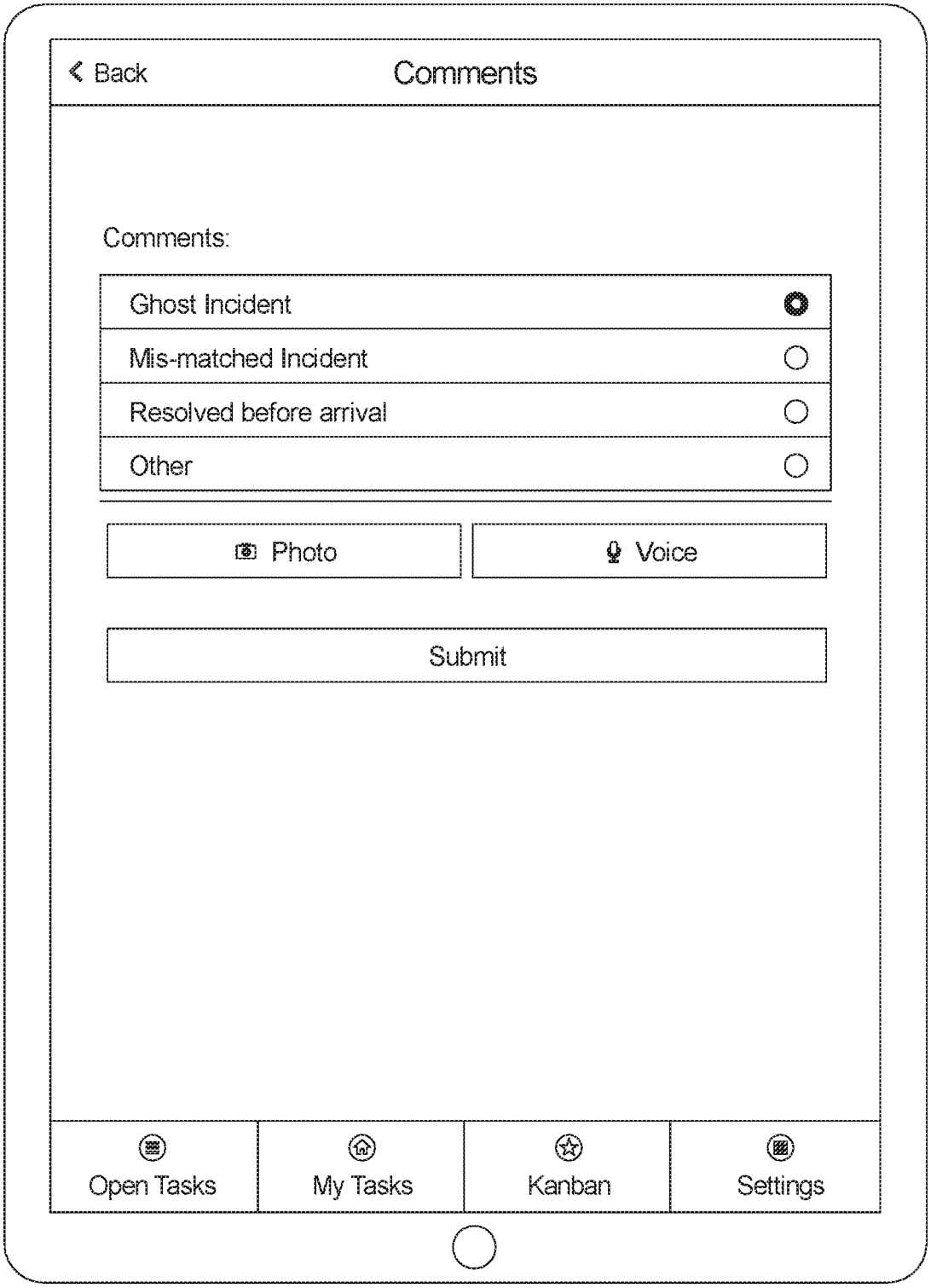

In various embodiments, the mobile device 140 enables the casino floor service management system user to input work item context information associated with a work item that the application server 120 uses to update the work item. For instance, in one embodiment, the mobile device 140 includes a camera that enables the casino floor service management system user to take a picture of or associated with the work item. In this embodiment, the mobile device 140 transmits the picture to the application server 120, which updates the work item to include that picture. In another embodiment, the mobile device 140 includes a video recorder that enables the casino floor service management system user to take a video of or associated with the work item. In this embodiment, the mobile device 140 transmits the video to the application server 120, which updates the work item to include that video. In another embodiment, the mobile device 140 includes a text-recording tool that enables the casino floor service management system user to input text associated with the work item. In this embodiment, the mobile device 140 transmits the text to the application server 120, which updates the work item to include that text. FIG. 2K is a screenshot of an example work item context information input interface.

In certain embodiments, the mobile device 140 enables the casino floor service management system user to indicate that the work item has been resolved. In these embodiments, when the mobile device 140 receives an indication that the work item has been resolved, the mobile device 140 transmits an indication that the work item has been resolved to the application server 120 over the Internet 101, which the application server 120 uses to update the work item.

In various embodiments, the mobile device 140 includes a global positioning system configured to determine the location of the mobile device 140. In these embodiments, the mobile device 140 transmits the location of the mobile device 140 to the application server 120, which uses the location to approximate the location of the casino floor service management system user. In certain embodiments, the casino floor service management system uses the location of the casino floor service management system user as compared to the location of the work item to calculate an estimated time of arrival of the user to the work item, which the mobile device 140 may display.

In certain embodiments, the mobile device 140 automatically provides an indication or alert when a new work item is added to the backlog, such as by outputting an auditory indication (e.g., by outputting a particular tone); by providing a tactile indication (e.g., by vibrating); and/or by displaying a visual indication (e.g., by flashing the display of the mobile device 140). In other embodiments, the mobile device 140 enables the casino floor service management system user to set custom alerts such that the mobile device 140 automatically provides an indication or alert when a new work item meeting certain criteria (such as a work item having a designated priority level or a designated priority level) is added to the backlog.

Figure 2L:
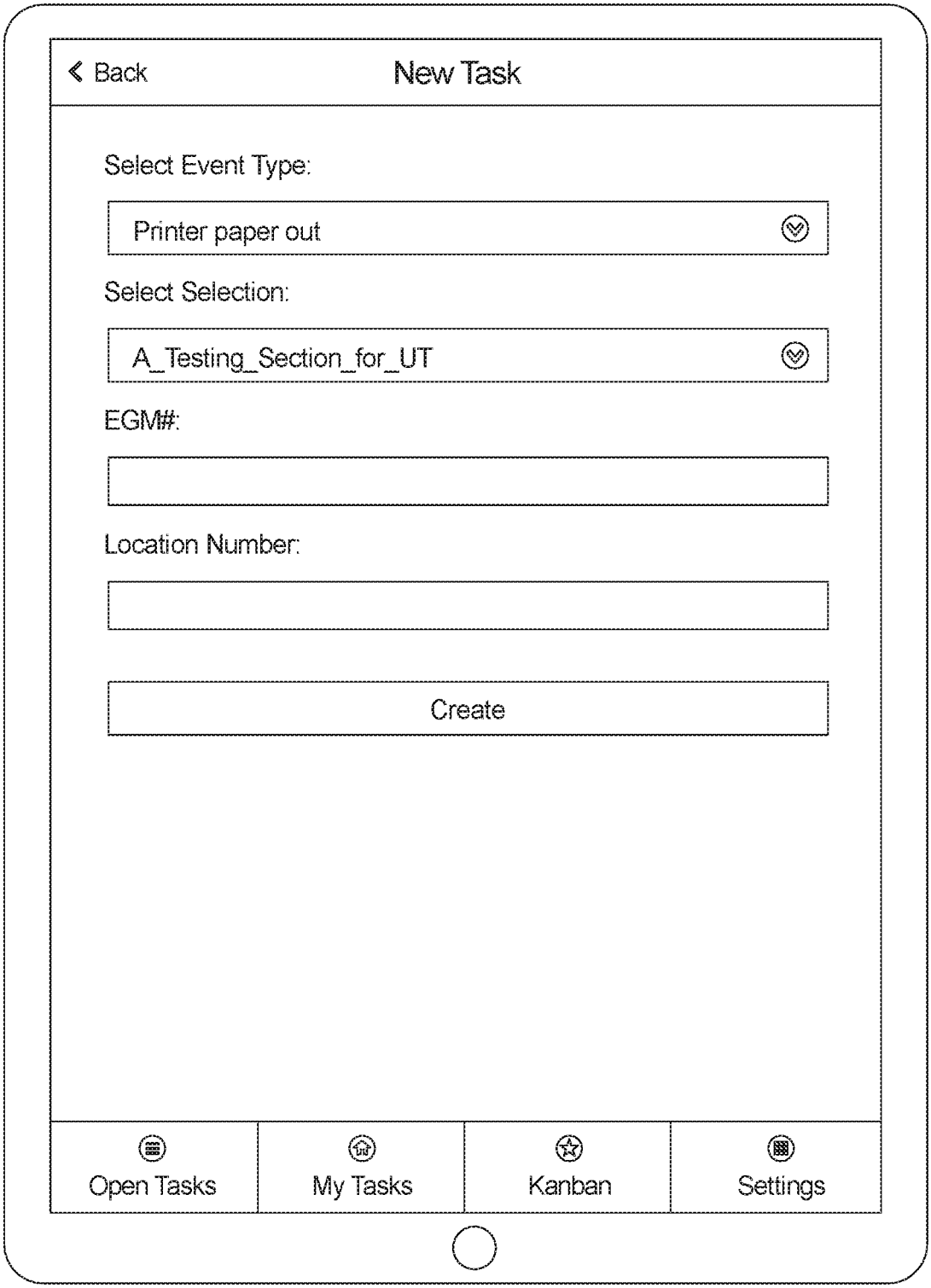

In various embodiments, the mobile device 140 enables the casino floor service management system user to create work items. For instance, if the casino floor service management system user notices that an EGM is malfunctioning (i.e., notices a floor event) and does not see a work item associated with that floor event, the mobile device 140 enables the casino floor service management system user to create a work item for that floor event. FIG. 2L is a screenshot of an example work item creation interface.

Figure 2M:
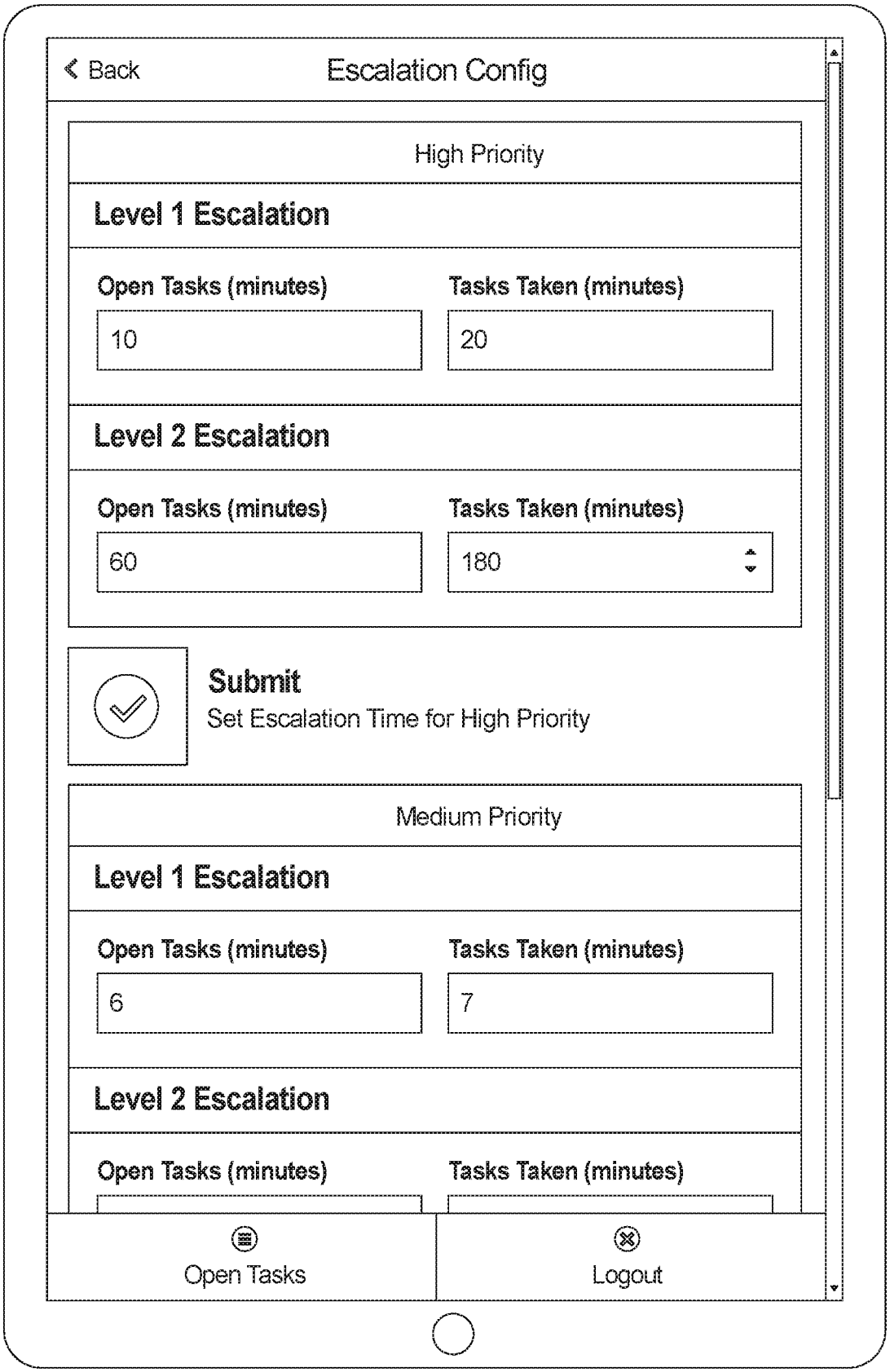

In various embodiments, the mobile device 140 enables the casino floor service management system user to escalate a work event by increasing the priority level of that work event. In certain such embodiments, the mobile device enables the casino floor service management system user to do so if certain criteria are met. For instance, in one embodiment, the mobile device enables a casino floor service management system user to escalate a work event associated with a non-functioning EGM when a designated percentage of the EGMs within the casino are not functioning. FIG. 2M is a screenshot of an example work item escalation interface.

Figure 2N:
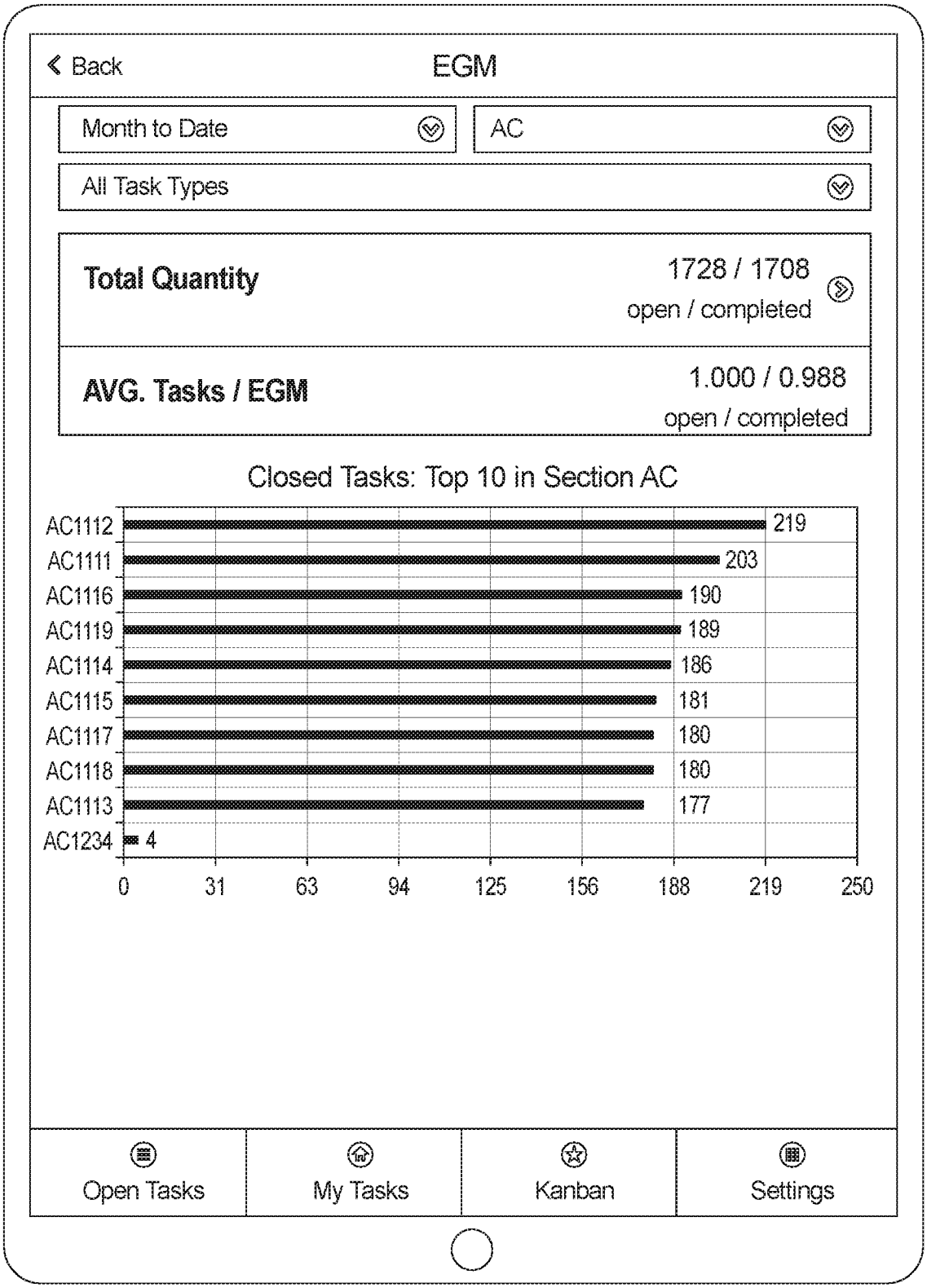
Figure 20:
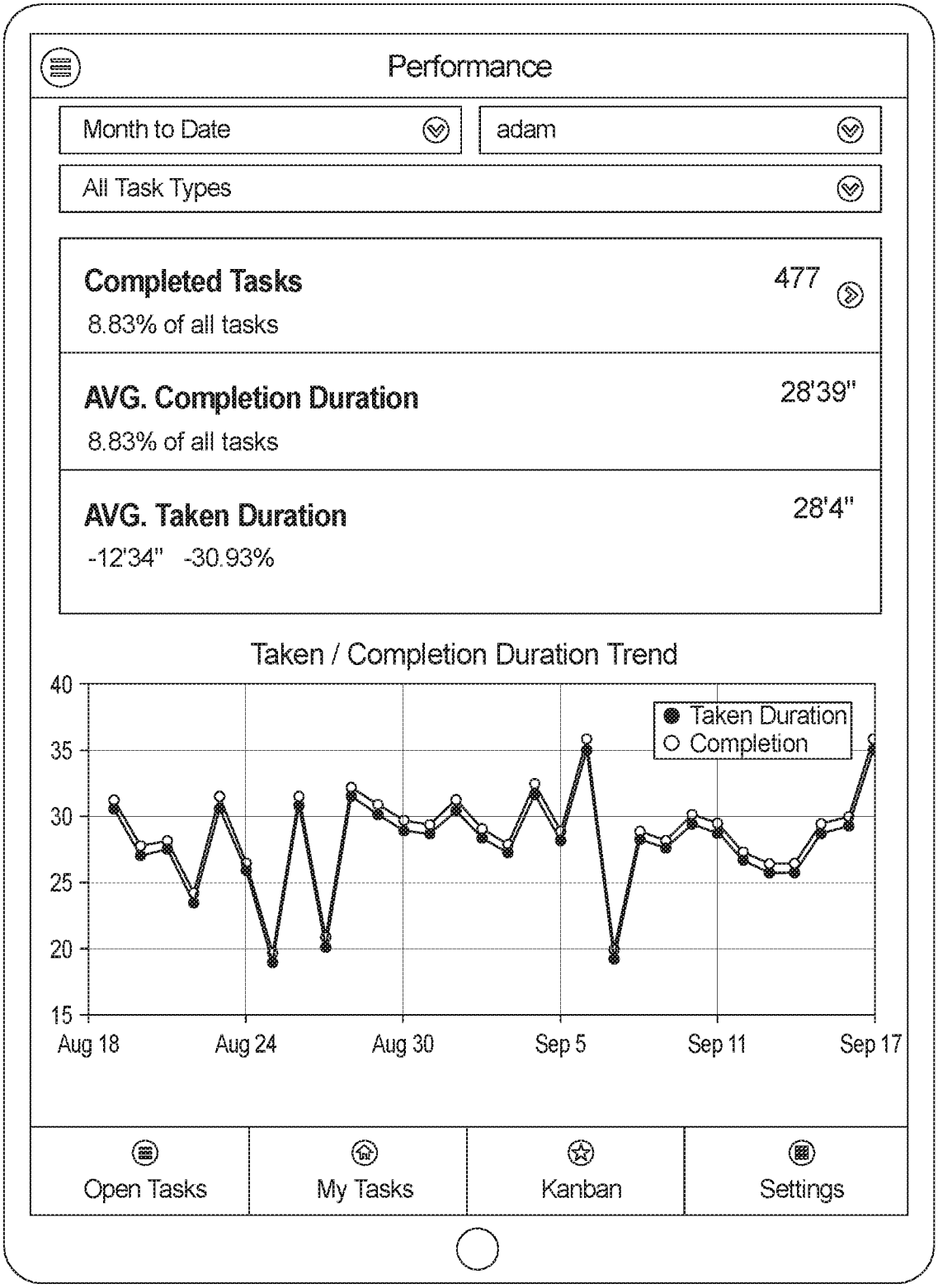
Figure 2P:
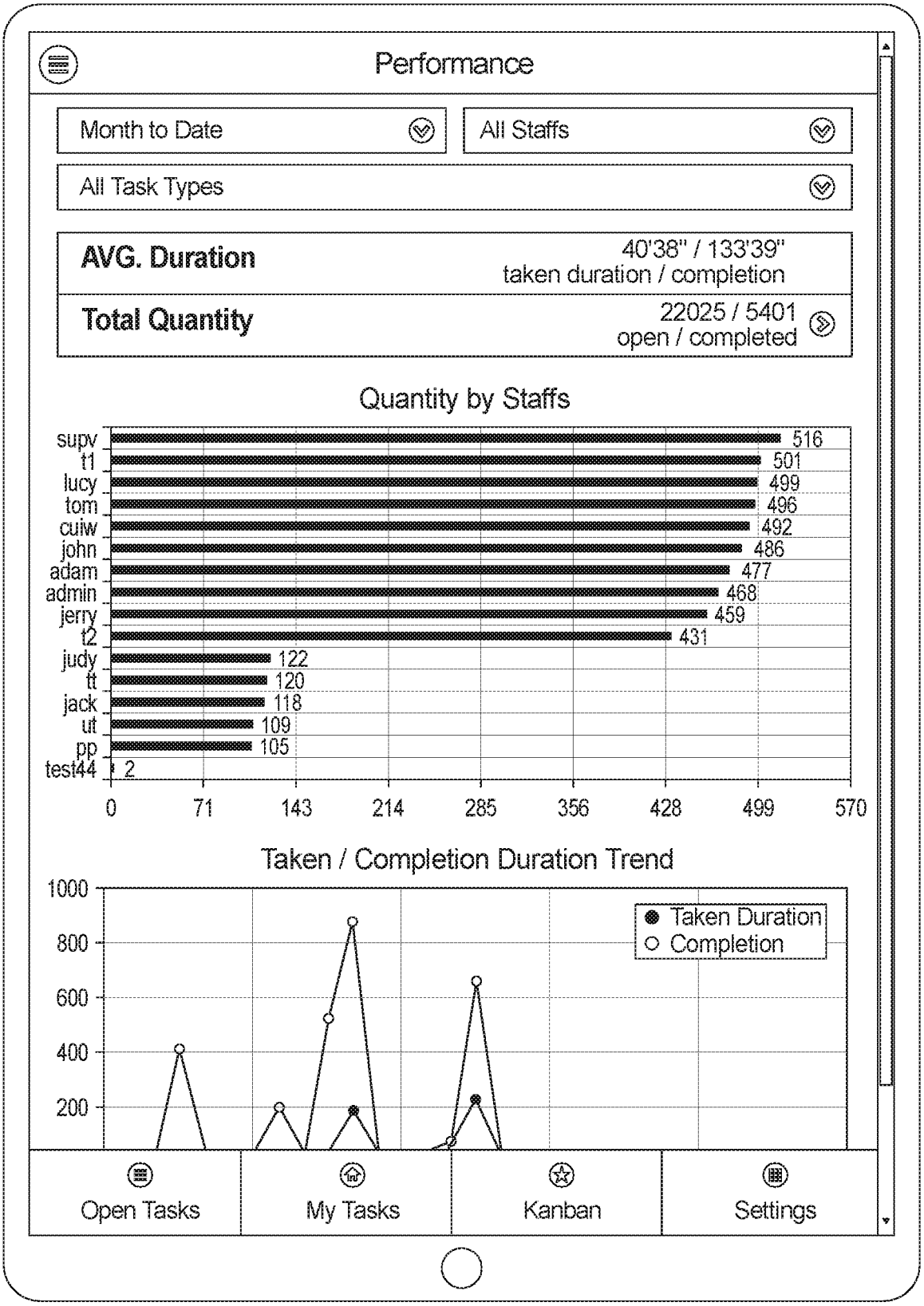

In certain embodiments, the mobile device 140 enables the casino floor service management system user to view certain metrics associated with the casino floor service management system such as, but not limited to: (1) the average time elapsed between the generation of a work item and the resolution of that work item (such as per casino floor service management system user, per casino floor section, or per casino floor); (2) the average time elapsed between the generation of a work item and that work item being selected (such as per casino floor service management system user, per casino floor section, or per casino floor); (3) the quantity of work items generated (such as per casino floor service management user, per casino floor section, per EGM, or per casino floor); (4) the quantity of work items selected (such as per casino floor service management user, per casino floor section, per EGM, or per casino floor); and/or (5) the quantity of work items resolved (such as per casino floor service management user, per casino floor section, per EGM, or per casino floor). FIGS. 2N, 2O, and 2P are screenshots of example metric review interfaces.

Figure 2Q:
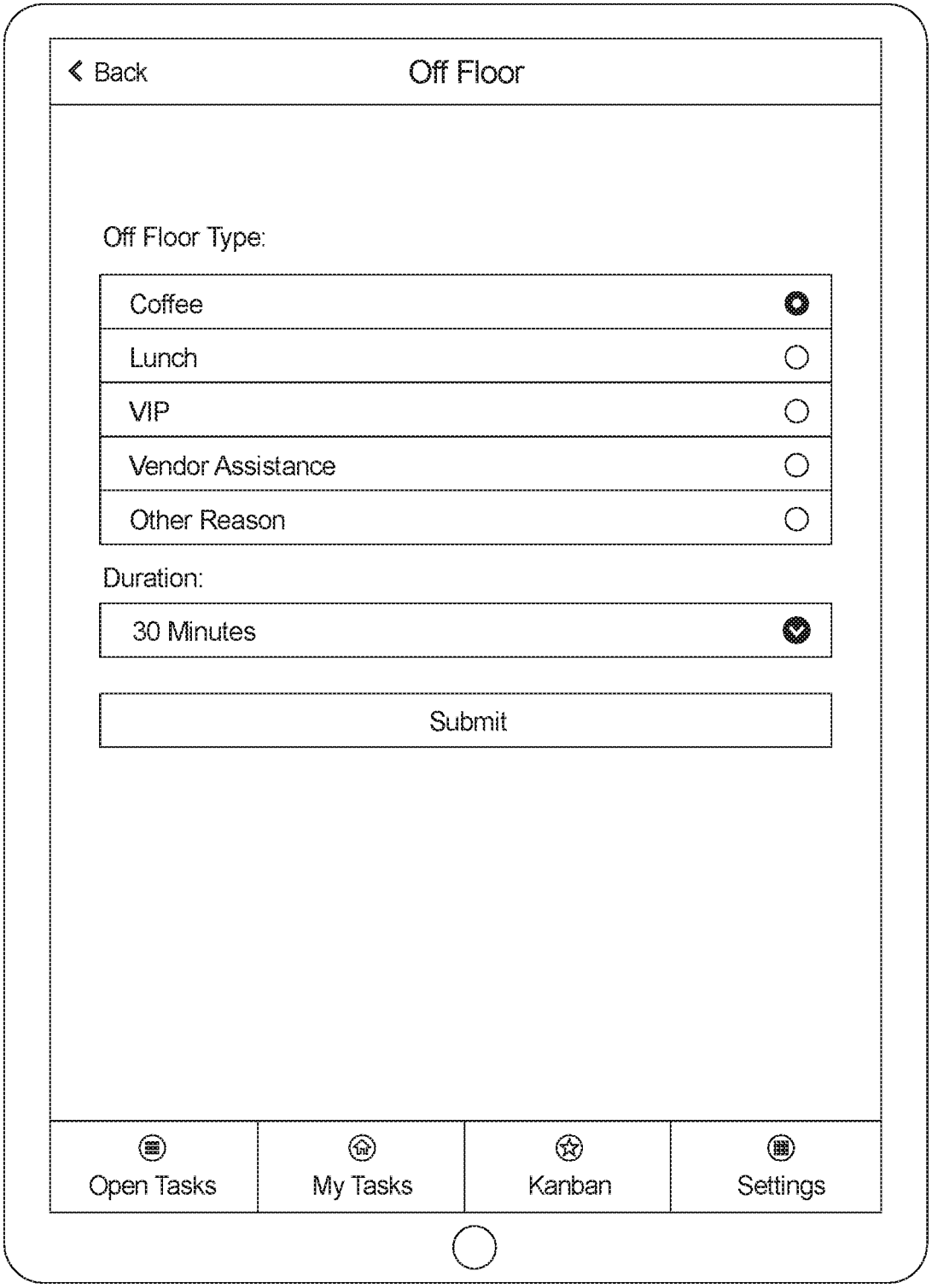

In various embodiments, the mobile device 140 enables the casino floor service management system user to indicate that the casino floor service management system user is taking a scheduled work break. FIG. 2Q is a screenshot of an example break input interface.

Figure 2R:
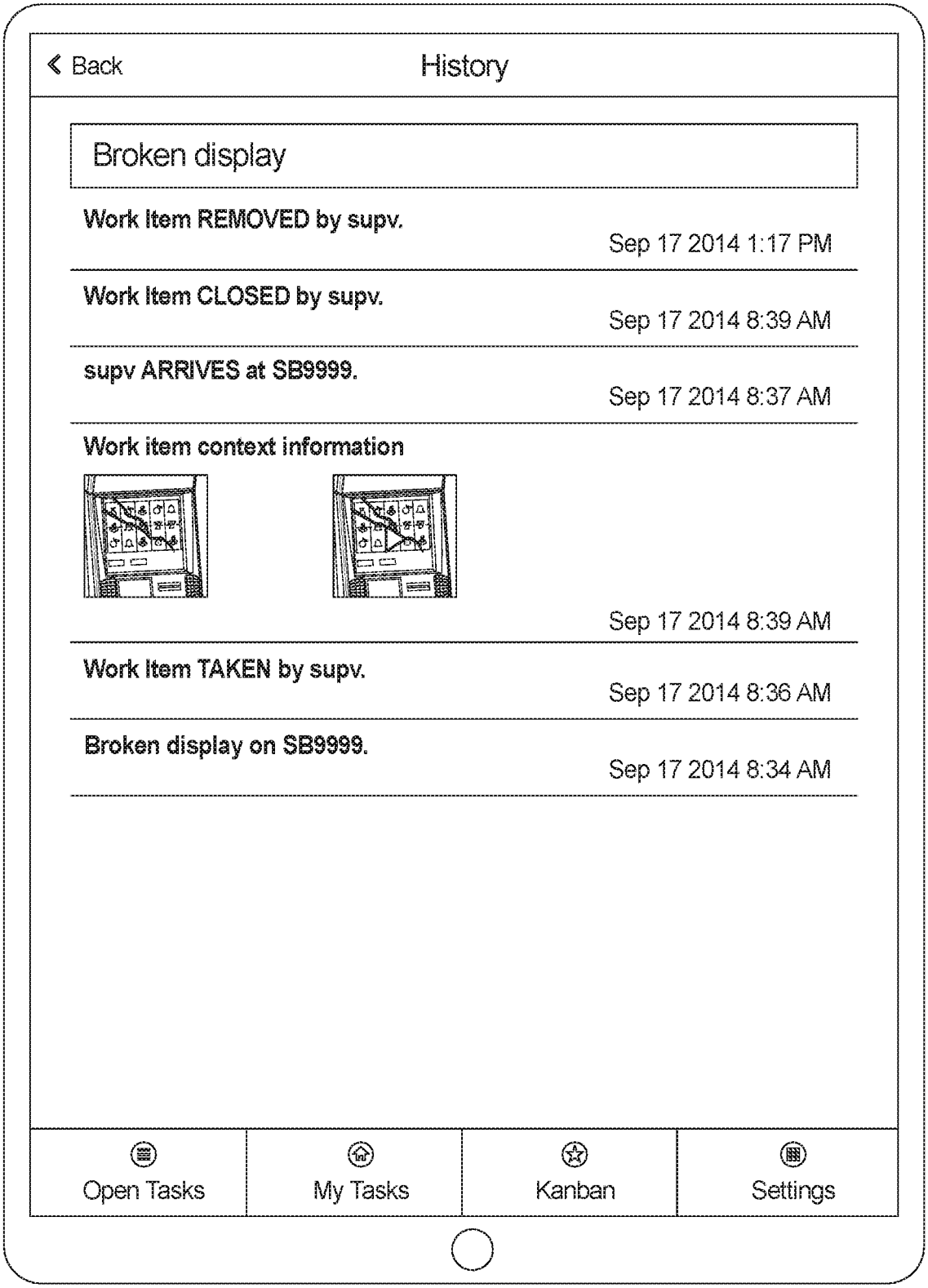

In various embodiments, the mobile device 140 enables the casino floor service management system user to view the history of a particular work item. FIG. 2R is a screenshot of an example work item history interface.

In certain embodiments, the mobile device 140 provides a casino floor service management system user-to-casino floor service management system user communication interface that enables casino floor service management system users to communicate with one another.

2. Casino Floor Service Management System Operation

2.1 General Operation

Figure 3:
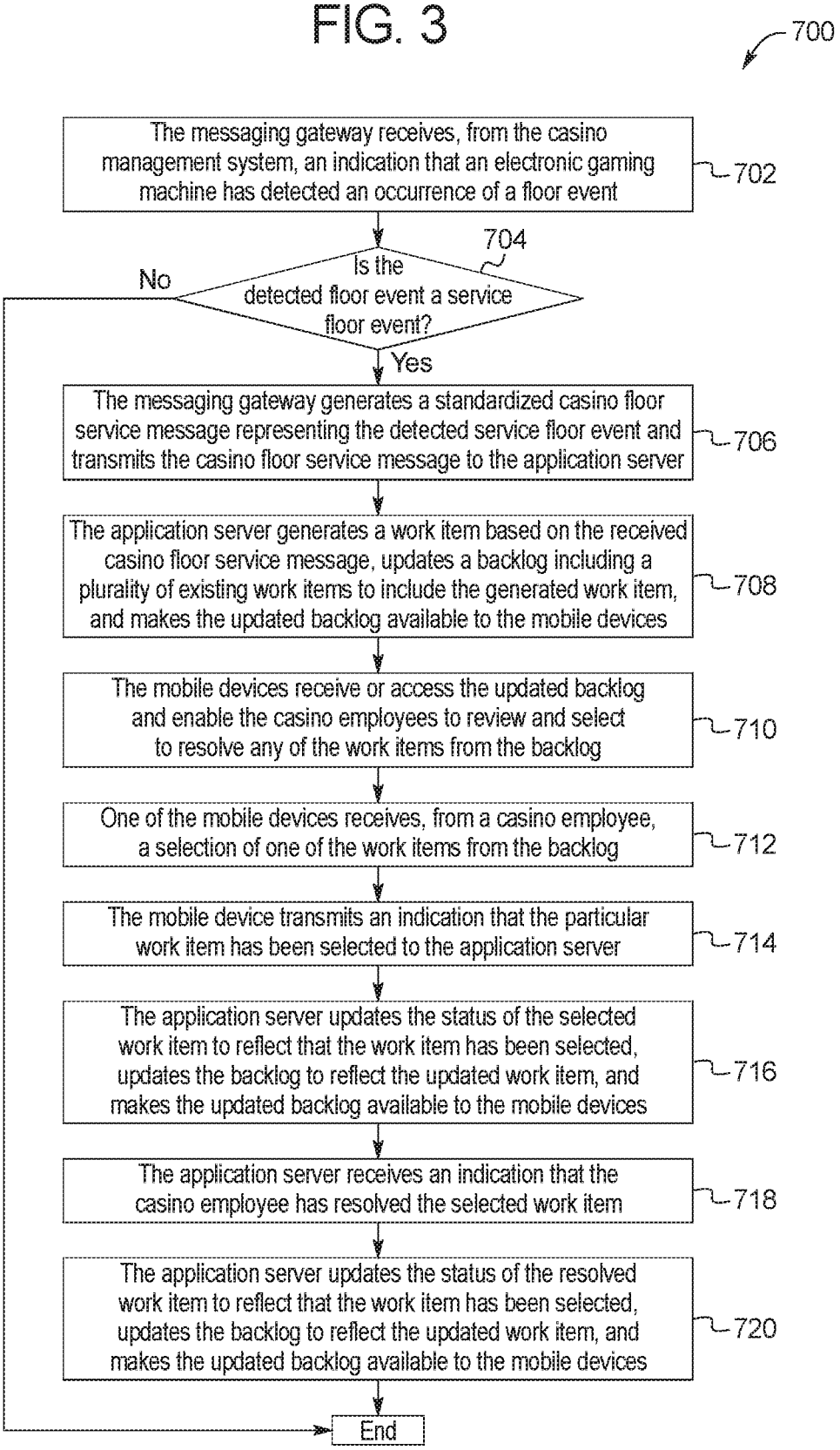
FIG. 3 is a flowchart of an example process or method of operating the casino floor service management system of the present disclosure.

FIG. 3 is a flowchart of one embodiment of a process or method 700 of operating the casino floor service management system of the present disclosure. More specifically, FIG. 3 shows an embodiment of a process of operating the casino floor service management system of the present disclosure from the initial identification of a floor event at an EGM to the eventual resolution of that floor event by a casino floor service management system user.

In various embodiments, the process 700 is (at least in part) represented by a set of instructions stored in one or more memories and executed by one or more processors. Although the process 700 is described with reference to the flowchart shown in FIG. 3, it should be appreciated that many other processes of performing the acts associated with this illustrated process 700 may be employed. For example, the order of certain of the illustrated blocks and/or diamonds may be changed, certain of the illustrated blocks and/or diamonds may be optional, and/or certain of the illustrated blocks and/or diamonds may not be employed.

As described above, in operation, the EGMs monitor for the occurrence of floor events. Here, an EGM detects the occurrence of a floor event and transmits the appropriate indication or notification to the CMS over the local casino network. The CMS receives, from the EGM, the indication or notification and relays that indication or notification to the messaging gateway over the local casino network 203. The messaging gateway receives, from the CMS, the indication or notification, as indicated by block 702. The messaging gateway determines whether the detected floor event is a service floor event or a non-service floor event, as indicated by diamond 704. If the messaging gateway determines that the detected floor event is a non-service floor event, the process 700 ends. If, on the other hand, the messaging gateway determines that the detected floor event is a service floor event, the messaging gateway generates a standardized casino floor service message representing the detected service floor event and transmits the casino floor service message to the application server over a network, which is an internet in this embodiment, as indicated by block 706.

Upon receiving the casino floor service message from the messaging gateway, the application server: (1) generates a work item based on the received casino floor service message, (2) updates a backlog of work items to include the generated work item, and (3) makes the updated backlog available to the mobile devices, as indicated by block 708. The mobile devices receive or otherwise access the updated backlog and enable the casino floor service management system users to review and select to resolve any of the work items from the backlog (such as by using a mobile application installed thereon or a web browser installed thereon), as indicated by block 710.

One of the mobile devices receives, from a casino floor service management system user, a selection of one of the work items from the backlog, as indicated by block 712. The mobile device transmits an indication that the work item has been selected to the application server over the internet, as indicated by block 714. Upon receiving the indication that the work item has been selected, the application server updates the status of the work item to reflect that the work item has been selected, updates the backlog to reflect the updated work item, and makes the updated backlog available to the mobile devices, as indicated by block 716. After selecting the work item, the casino floor service management system user (eventually) travels to the work item location and resolves the selected work item. The application server receives an indication that the casino floor service management system user has resolved the selected work item, as indicated by block 718. The application server updates the status of the resolved work item to reflect that the work item has been resolved, updates the backlog to reflect the updated work item, and makes the updated backlog available to the mobile devices, as indicated by block 720. The process 700 then ends.

2.2 First Example

Described below is a first example of operation of the casino floor service management system 100 from the initial identification of a floor event at an EGM 240*a* to the eventual resolution of that floor event by a casino floor service management system user. In this first example, the EGM 240*a* detects the occurrence of a floor event: that the display device of the EGM 240*a* has stopped functioning. The EGM 240*a* transmits an appropriate indication or notification to the CMS 210 over the local casino network 203 reflecting the occurrence of the floor event (i.e., that the display device of the EGM 240*a* has stopped functioning). The CMS 210 receives, from the EGM 240*a*, the indication or notification of the floor event (i.e., that the display device of the EGM 240*a* has stopped functioning), and relays that indication or notification to the messaging gateway 110 over the local casino network 203.

Upon receiving the indication or notification of the floor event (i.e., that the display device of the EGM 240*a* has stopped functioning) from the CMS 210, the messaging gateway 110 determines whether the floor event is a service floor event or a non-service floor event. In this first example, upon receiving the indication or notification of the floor event (i.e., that the display device of the EGM 240*a* has stopped functioning), the messaging gateway 110 determines that the floor event is a service floor event. Accordingly, the messaging gateway 110 generates a standardized casino floor service message representing the service floor event (i.e., that the display device of the EGM 240*a* has stopped functioning) and transmits the casino floor service message to the application server 120 over the Internet 101.

Upon receiving the casino floor service message from the messaging gateway 110, the application server 120: (1) generates a first work item based on the received casino floor service message, (2) sets a status of the first work item to "OPEN" to indicate that the first work item is available, (3) updates a backlog of work items to include the first work item, and (4) makes the updated backlog available to the mobile devices 140. The mobile devices 140 receive or otherwise access the updated backlog including the newly-generated first work item and enable the casino floor service management system users to review the work items (including the first work item) in the backlog and select work items to resolve.

A first one of the mobile devices 140*a* receives a selection of the first work item from a slot technician. The first mobile device 140*a* transmits a first indication that the first work item has been selected to the application server 120 over the Internet 101. After receiving the first indication that the first work item has been selected, the application server 120: (1) updates the status of the first work item to "TAKEN" to reflect that the first work item has been selected, (2) updates the backlog accordingly to reflect the updated first work item, and (3) makes the updated backlog available to the mobile devices 140. The mobile devices 140 receive or otherwise access the updated backlog, which now reflects that the first work item has been selected.

After selecting the first work item, the slot technician (eventually) travels to the first work item location of the first work item, i.e., to the EGM 240*a*. Once the slot technician arrives at the first work item location, the first mobile device 140*a* enables the slot technician to input first work item context information related to the first work item, such as a photo of the EGM 240*a* (such as a photo of the broken display device), a video of the EGM 240*a* (such as a video of the broken display device), or text-based notes (such as a written description of the broken display device). After receiving the first work item context information from the slot technician, the first mobile device 140*a* transmits the first work item context information to the application server 120 over the Internet 101.

Upon receiving the first work item context information from the first mobile device 140*a*, the application server 120: (1) updates the first work item to reflect the first work item context information, (2) updates the backlog accordingly to reflect the updated first work item, and (3) makes the updated backlog available to the mobile devices. The mobile devices 140 receive or otherwise access the updated backlog, which now reflects the first work item context information.

In this first example, when the slot technician arrives at the first work item location to resolve the first work item, the slot technician indicates that he has arrived at the first work item location by inserting the slot technician's employee identification card into the EGM 240*a*. The EGM 240*a* transmits information associated with the slot technician's employee identification card to the CMS 210, which relays this information to the messaging gateway 110, which further relays this information to the application server 120. Based on this information, the application server 120 recognizes that the slot technician is located at the EGM 240*a* and is working to resolve the first work item. Accordingly, the application server 120: (1) updates the status of the first work item to "IN PROGRESS" to reflect that the slot technician is currently working to resolve the first work item, (2) updates the backlog accordingly to reflect the updated first work item, and (3) makes the updated backlog available to the mobile devices. The mobile devices 140 receive or otherwise access the updated backlog, which now reflects that the first work item is in the process of being resolved.

Once the slot technician resolves the first work item (e.g., repairs or replaces the broken display device), the slot technician removes the slot technician's employee identification card from the EGM 240*a*. The EGM 240*a* recognizes the removal of the employee identification card, and sends a suitable indication or notification to the CMS 210, which relays this indication or notification to the messaging gateway 110, which further relays this indication or notification to the application server 120. Based on this indication or notification, the application server 120 recognizes that the slot technician has resolved the first work item. Accordingly, the application server 120: (1) updates the status of the first work item to "CLOSED" to reflect that the slot technician has resolved the first work item, (2) updates the backlog accordingly to reflect the updated first work item, and (3) makes the updated backlog available to the mobile devices 140. The mobile devices 140 receive or otherwise access the updated backlog, which now reflects that the first work item has been resolved.

2.3 Second Example

Described below is a second example of operation of the casino floor service management system 100 from the initial identification of a floor event at an EGM 240*b* to the eventual resolution of that floor event by a casino floor service management system user. In this second example, the EGM 240*b* detects the occurrence of a floor event: that a VIP casino patron has inserted her player tracking card at the EGM 240*b*. The EGM 240*b* transmits an appropriate indication or notification to the CMS 210 over the local casino network 203 reflecting the occurrence of the floor event (i.e., that the VIP casino patron has inserted her player tracking card at the EGM 240*b*). The CMS 210 receives, from the EGM 240*b*, the indication or notification of the floor event (i.e., that the VIP casino patron has inserted her player tracking card at the EGM 240*b*), and relays that indication or notification to the messaging gateway 110 over the local casino network 203.

Upon receiving the indication or notification of the floor event (i.e., that the VIP casino patron has inserted her player tracking card at the EGM 240*b*) from the CMS 210, the messaging gateway 110 determines whether the floor event is a service floor event or a non-service floor event. In this second example, upon receiving the indication or notification of the floor event (i.e., that the VIP casino patron has inserted her player tracking card at the EGM 240*b*), the messaging gateway 110 determines that the floor event is a service floor event. Accordingly, the messaging gateway 110 generates a standardized casino floor service message representing the service floor event (i.e., that the VIP casino patron has inserted her player tracking card at the EGM 240*b*) and transmits the casino floor service message to the application server 120 over the Internet 101.

Upon receiving the casino floor service message from the messaging gateway 110, the application server 120: (1) generates a second work item based on the received casino floor service message, (2) sets a status of the second work item to "OPEN" to indicate that the second work item is available, (3) updates a backlog of work items to include the second work item, and (4) makes the updated backlog available to the mobile devices 140. The mobile devices 140 receive or otherwise access the updated backlog including the newly-generated second work item and enable the casino floor service management system users to review the work items (including the second work item) in the backlog and select work items to resolve.

A second one of the mobile devices 140*b* receives a selection of the second work item from a floor attendant. The second mobile device 140*b* transmits a second indication that the second work item has been selected to the application server 120 over the Internet 101. After receiving the second indication that the second work item has been selected, the application server 120: (1) updates the status of the second work item to "TAKEN" to reflect that the second work item has been selected, (2) updates the backlog accordingly to reflect the updated second work item, and (3) makes the updated backlog available to the mobile devices 140. The mobile devices 140 receive or otherwise access the updated backlog, which now reflects that the second work item has been selected.

After selecting the second work item, the floor attendant (eventually) travels to the second work item location of the second work item, i.e., to the EGM 240*b*. Once the floor attendant arrives at the second work item location, the second mobile device 140*b* enables the floor attendant to input second work item context information related to the second work item, such as a photo (such as of the VIP casino patron), a video (such as of the VIP casino patron), or text-based notes (such as about the VIP casino patron). After receiving the second work item context information from the floor attendant, the second mobile device 140*b* transmits the second work item context information to the application server 120 over the Internet 101.

Upon receiving the second work item context information from the second mobile device 140*b*, the application server 120: (1) updates the second work item to reflect the second work item context information, (2) updates the backlog accordingly to reflect the updated second work item, and (3) makes the updated backlog available to the mobile devices. The mobile devices 140 receive or otherwise access the updated backlog, which now reflects the second work item context information.

In this second example, when the floor attendant arrives at the second work item location to resolve the second work item, the floor attendant indicates that he has arrived at the second work item location by making an appropriate input to the mobile device 140*b*, such as by actuating an appropriate button or checking an appropriate box. The mobile device 140*b* transmits this information to the application server 120 over the Internet 101. Based on this information, the application server 120 recognizes that the floor attendant is located at the second work item location and is working to resolve the second work item. Accordingly, the application server 120: (1) updates the status of the second work item to "IN PROGRESS" to reflect that the floor attendant is currently working to resolve the second work item, (2) updates the backlog accordingly to reflect the updated second work item, and (3) makes the updated backlog available to the mobile devices. The mobile devices 140 receive or otherwise access the updated backlog, which now reflects that the second work item is in the process of being resolved.

Once the floor attendant resolves the second work item (e.g., welcomes the VIP casino patron to the casino), the floor attendant makes an appropriate input to the mobile device 140*b*, such as by actuating an appropriate button or checking an appropriate box, to indicate that the floor attendant ahs resolved the second floor event. The mobile device 140*b* transmits this information to the application server 120 over the Internet 101. Based on this information, the application server 120: (1) updates the status of the second work item to "CLOSED" to reflect that the floor attendant has resolved the second work item, (2) updates the backlog accordingly to reflect the updated second work item, and (3) makes the updated backlog available to the mobile devices 140. The mobile devices 140 receive or otherwise access the updated backlog, which now reflects that the second work item has been resolved.

3. Variations

In certain embodiments, the messaging gateway is configured to communicate with the application server over the local casino network. In various embodiments, the mobile devices are configured to wirelessly communicate with the application server over the local casino network. In one such embodiment, the messaging gateway, the application server, and the data server are all located on the casino premises.

Figure 4:
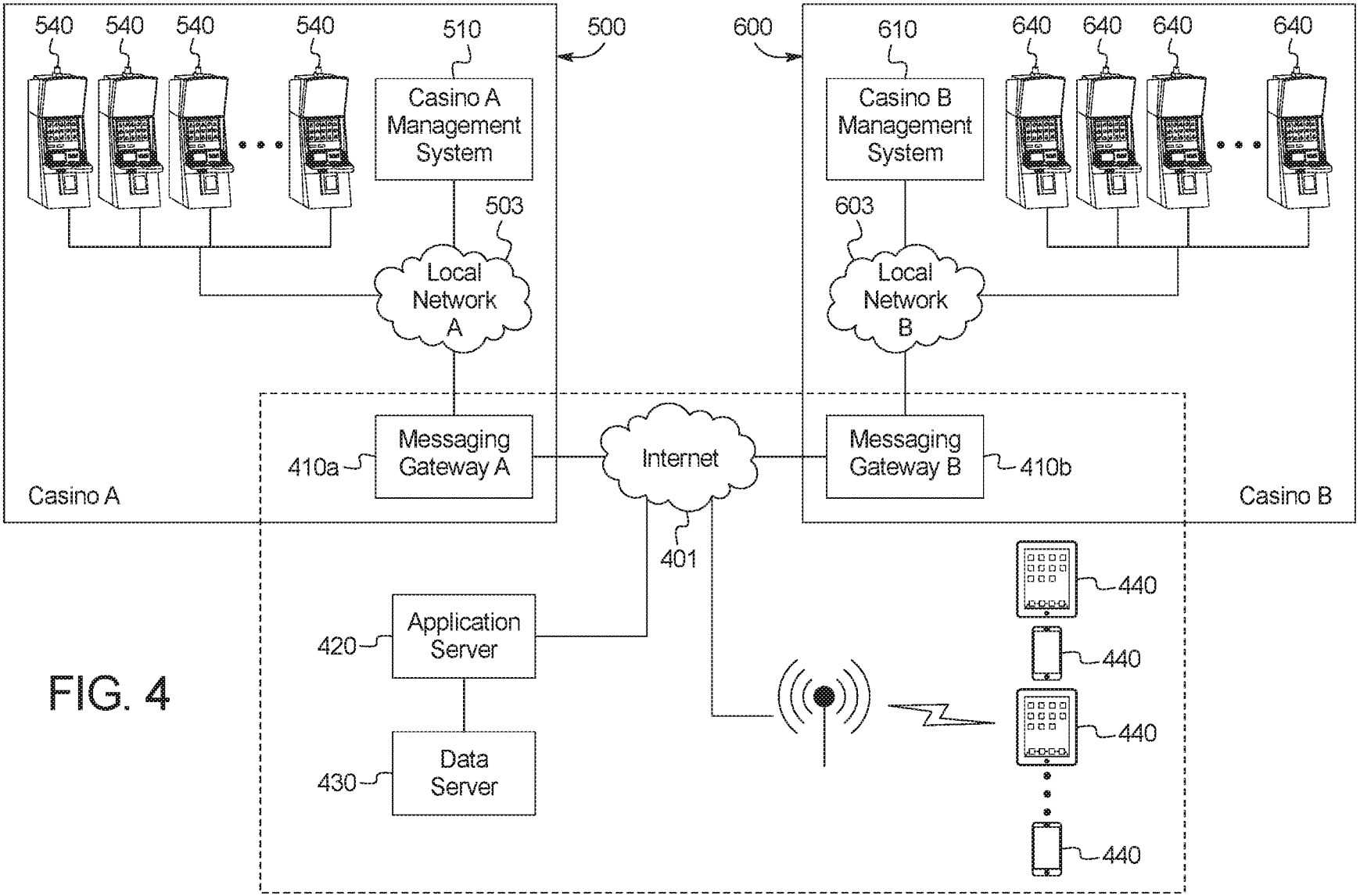
FIG. 4 is a block diagram of another embodiment of the casino floor service management system of the present disclosure.

In certain embodiments, the casino floor service management system is configured to integrate with the CMS's of multiple casinos and leverage the knowledge and experience of casino floor service management system users to efficiently resolve service floor events across all of the casinos in a timely manner. FIG. 4 illustrates one such embodiment of the casino floor service management system of the present disclosure, which is generally indicated by numeral 400. The casino floor service management system 400 includes: (a) a first messaging gateway 410*a*, (b) a second messaging gateway 410*b*, (c) an application server 420, (d) a data server 430, and (e) a plurality of mobile devices 440. The messaging gateway 410*a* and the application server 420 are configured to communicate with one another over a suitable wired or wireless network, such as an internet 401. The messaging gateway 410*b* and the application server 420 are configured to communicate with one another over a suitable wired or wireless network, such as an internet 401. The application server 420 and the data server 430 are configured to communicate with one another over a suitable wired or wireless network. The application server 420 and the mobile devices 440 are configured to communicate with one another over a suitable wireless network, such as the internet 401.

In this embodiment, the casino floor service management system 400 is employed to facilitate the resolution of service floor events for a plurality of EGMs 540 of a first casino 500 and a plurality of EGMs 640 of a second casino 600. The first casino 500 includes a CMS 510 configured to communicate with the EGMs 540 over a suitable wired or wireless network, such as the first casino's local network 503. The second casino 600 includes a CMS 610 configured to communicate with the EGMs 640 over a suitable wired or wireless network, such as the second casino's local network 603. The first messaging gateway 410*a* of the casino floor service management system 400 and the CMS 510 are configured to communicate with one another over the first casino's local network 503. The second messaging gateway 410*b* of the casino floor service management system 400 and the CMS 610 are configured to communicate with one another over the second casino's local network 603.

In certain embodiments, the casino floor service management system provides different casino floor service management system users different levels of access. For example, the casino floor service management system provides casino floor service management system users having an "Administrator" designation with a highest level of access, casino floor service management system users having a "Supervisor" designation with a lower level of access, and casino floor service management system users having an "Employee" designation with an level lower level of access.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
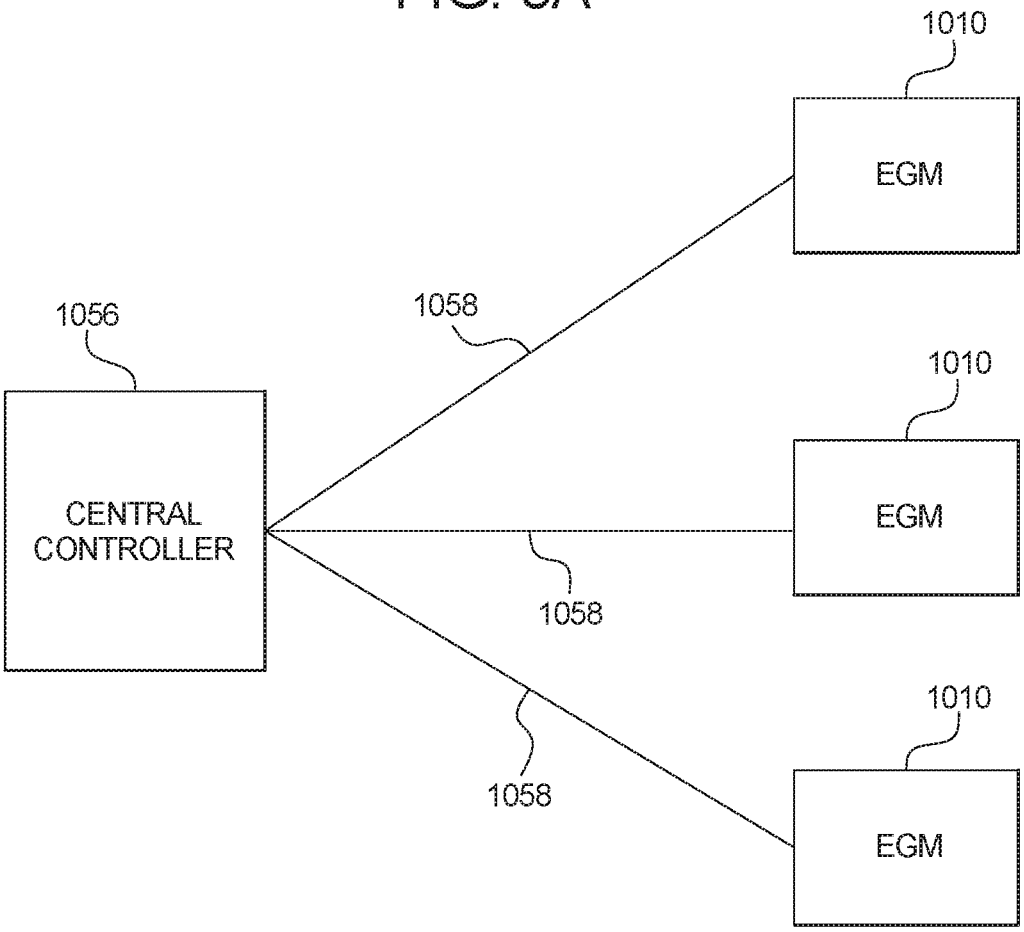
FIG. 5A is a schematic block diagram of an example network configuration of one embodiment of a gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
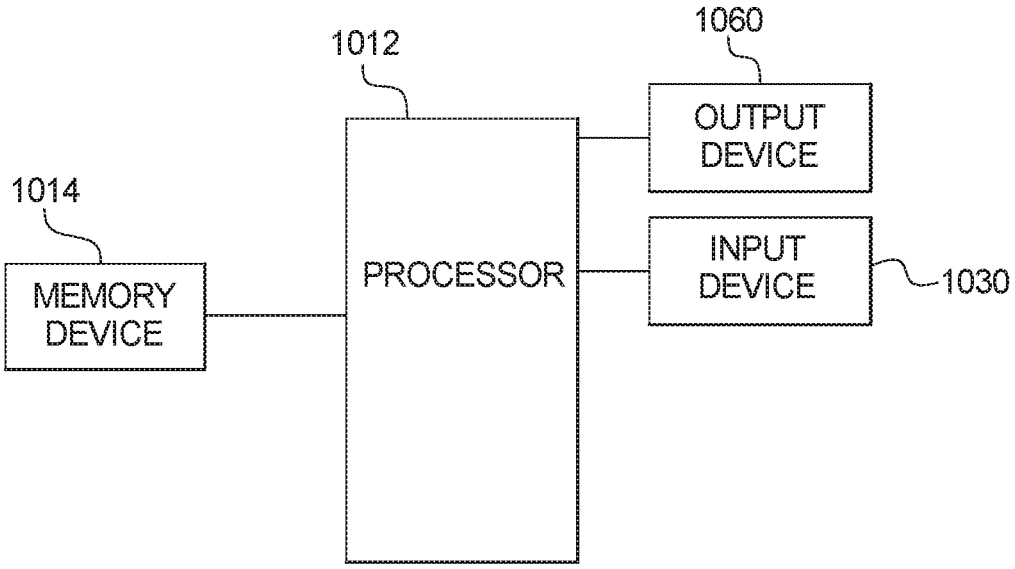
FIG. 5B is a schematic block diagram of an example electronic configuration of a gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
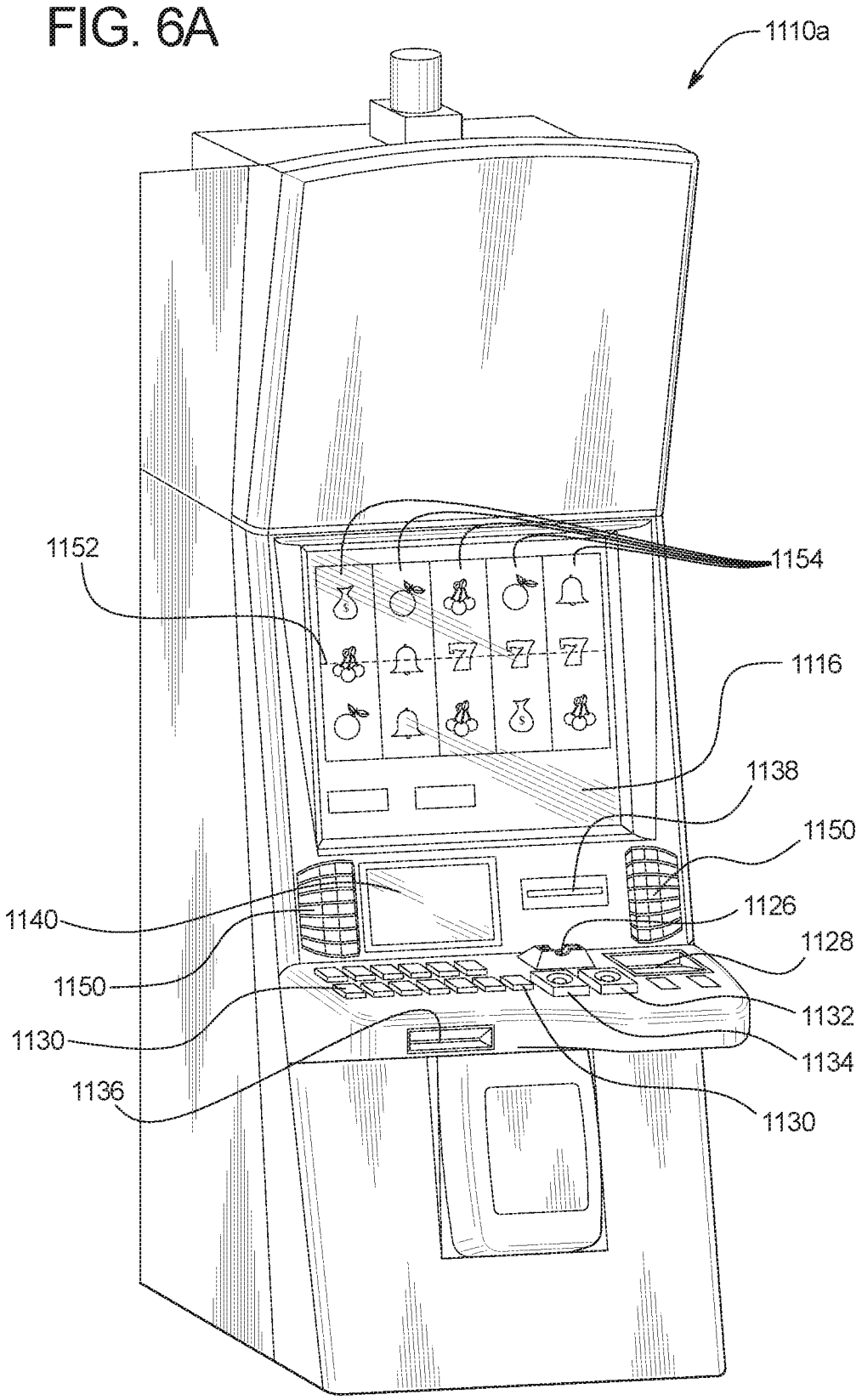
FIGS. 6A and 6B are perspective views of example alternative embodiments of gaming systems of the present disclosure.
Figure 6B:
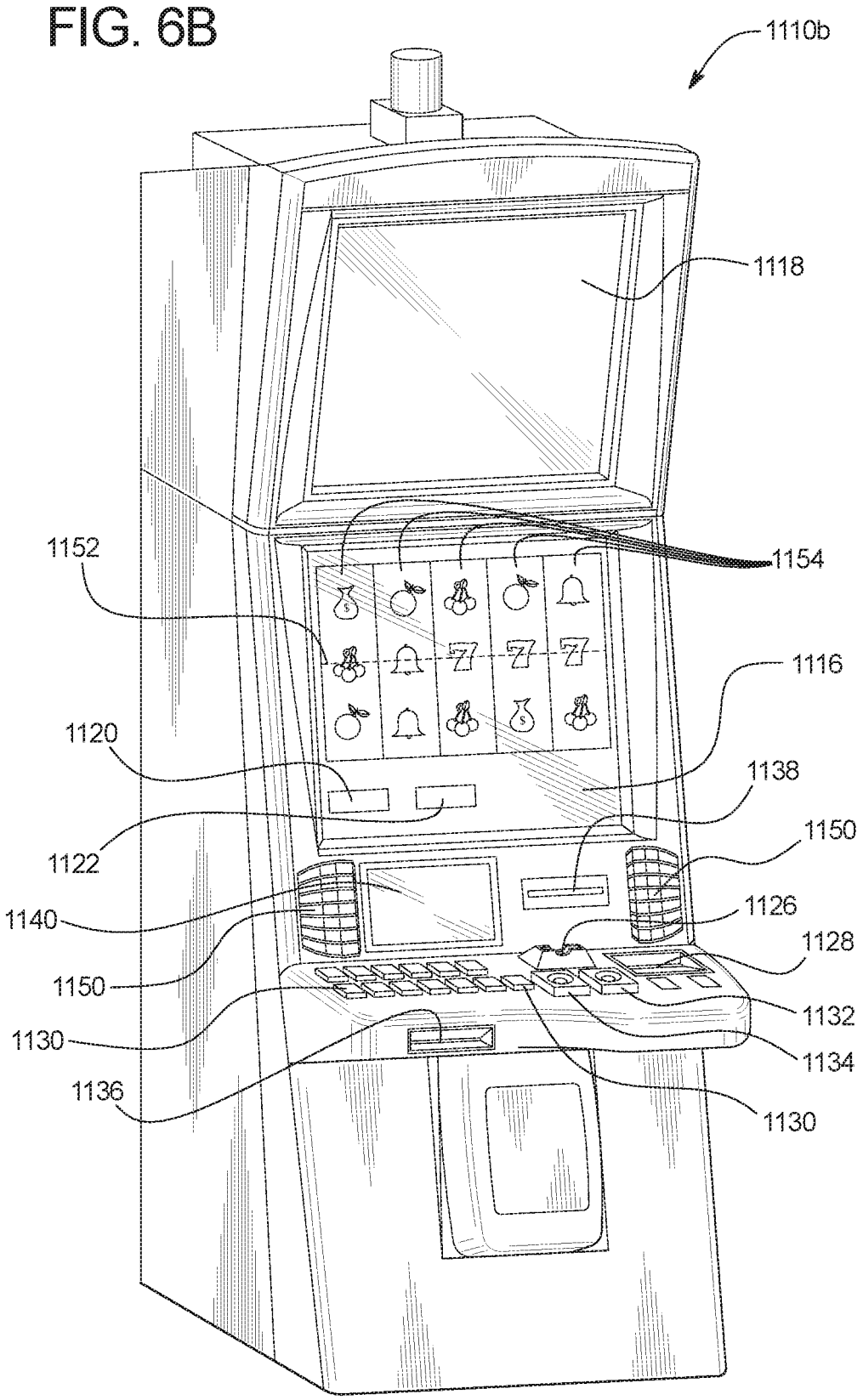

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs 1110*a* and 1110*b* that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs 1110*a* and 1110*b* illustrated in FIGS. 6A and 6B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. The example EGMs 1110*a* and 1110*b* illustrated in FIGS. 6A and 6B each include one or more input devices 1130.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs 1110*a* and 1110*b* illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 1110*a* illustrated in FIG. 6A includes a central display device 1116, a player tracking display 1140, a credit display 1120, and a bet display 1122. The example EGM 1110*b* illustrated in FIG. 6B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs 1110*a* and 1110*b* illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs 1110*a* and 1110*b* illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs 1110*a* and 1110*b* illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 1110*a* and 1110*b* shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electromechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs 1110*a* and 1110*b* shown in FIGS. 6A and 6B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat.

Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of operating a casino floor service management system, said method comprising:

receiving, by a casino floor service management system messaging gateway, data associated with an indication of one of a plurality of different floor events occurring at an electronic gaming machine located on a casino floor associated with the casino floor service management system;

determining, by at least one messaging gateway processor of the casino floor service management system messaging gateway, if said floor event occurring at the electronic gaming machine is one of a plurality of different service floor events; and responsive to a determination that said floor event occurring at the electronic gaming machine is one of the plurality of different service floor events, transmitting data associated with an indication of said floor event occurring at the electronic gaming machine to a casino floor service management system application server, wherein the casino floor service management system application server services, via the casino floor service management system messaging gateway, the casino floor service management system associated with the casino floor, and further concurrently services, via another casino floor service management system messaging gateway, another casino floor service management system associated with another casino floor, and responsive to receipt of the data associated with indication of said floor event, at least one application server processor of the casino floor service management system application server generates a casino floor work item associated with said floor event, updates a backlog including a plurality of casino floor work items to include the generated casino floor work item and any association of a selected casino floor work item with a system user associated with one of a plurality of mobile devices, and after updating the backlog, automatically causes a transmission of data associated with the updated backlog to each of the plurality of mobile devices, wherein each of the plurality of mobile devices automatically displays the updated backlog of casino floor work items available to be selected independent of any inputs received via any of the plurality of mobile devices to access the updated backlog, and responsive to receiving, from the mobile device associated with the system user associated with the selected casino floor work item, casino floor work item context information comprising an image associated with the selected casino floor work item, the at least one application server processor of the casino floor service management system application server updates the selected casino floor work item to include the casino floor work item context information.

2. The method of claim 1, wherein the casino floor service management system messaging gateway receives the data associated with indication of the occurrence of the one of the plurality of different floor events from a casino management system.

3. The method of claim 2, wherein the casino management system receives the data associated with indication of the occurrence of the one of the plurality of different floor events from the electronic gaming machine.

4. The method of claim 1, further including not transmitting, by the casino floor service management system messaging gateway, the data associated with indication of said floor event to the casino floor service management system application server responsive to said floor event not being one of the plurality of different service floor events.

5. The method of claim 1, wherein the at least one application server processor of the casino floor service management system application server makes the updated backlog available for download by the plurality of mobile devices.

6. The method of claim 1, wherein the at least one application server processor of the casino floor service management system application server determines that the casino floor work item is not a duplicate of an existing casino floor work item awaiting resolution prior to updating the backlog.

7. The method of claim 1, wherein the at least one application server processor of the casino floor service management system application server further updates the backlog to indicate that the selected casino floor work item has been resolved.

8. A casino floor service management system comprising:

an application server configured to service, via a casino floor service management system messaging gateway, the casino floor service management system associated with a casino floor, and concurrently service, via another casino floor service management system messaging gateway, another casino floor service management system associated with another casino floor, and comprising at least one application server processor and at least one application server memory device that stores a plurality of application server instructions that, when executed by the at least one application server processor, cause the at least one application server processor to:

responsive to an occurrence of one of a plurality of different floor events at an electronic gaming machine located on the casino floor associated with the casino floor service management system, and a determination that said floor event is one of a plurality of different service floor events, receive, from the casino floor service management system messaging gateway, data associated with an indication of the floor event occurring at the electronic gaming machine;

generate a casino floor work item associated with said floor event;

update a backlog including a plurality of casino floor work items to include the generated casino floor work item and any association of a selected casino floor work item with a system user associated with one of a plurality of mobile devices;

after updating the backlog, cause an automatic transmission of data associated with the updated backlog to each of the plurality of mobile devices, wherein each of the plurality of mobile devices automatically displays the updated backlog of casino floor work items available to be selected independent of any inputs received via any of the plurality of mobile devices to access the updated backlog, and responsive to receiving, from the mobile device associated with the system user associated with the selected casino floor work item, casino floor work item context information comprising an image associated with the selected casino floor work item, update the selected casino floor work item to include the casino floor work item context information.

9. The casino floor service management system of claim 8, wherein the messaging gateway receives data associated with the indication of the occurrence of the one of the plurality of different floor events from a casino management system.

10. The casino floor service management system of claim 8, wherein the application server receives data associated with the indication of the occurrence of the one of the plurality of different floor events from the electronic gaming machine.

11. The casino floor service management system of claim 8, wherein the plurality of messaging gateway instructions, when executed by the at least one messaging gateway processor, cause the at least one messaging gateway processor to not transmit data associated with the indication of said floor event to the application server responsive to said floor event not being one of the plurality of different service floor events.

12. The casino floor service management system of claim 8, wherein the plurality of application server instructions, when executed by the at least one application server processor, cause the at least one application server processor to make the updated backlog available for download by the plurality of mobile devices.

13. The casino floor service management system of claim 8, wherein the plurality of application server instructions, when executed by the at least one application server processor, cause the at least one application server processor to receive data associated with an indication that the selected casino floor work item has been resolved.

14. The casino floor service management system of claim 13, wherein the plurality of application server instructions, when executed by the at least one application server processor, cause the at least one application server processor to further update the backlog to indicate that the selected casino floor work item has been resolved.

15. A method of operating a casino floor service management system, the method comprising:

responsive to an occurrence of one of a plurality of different floor events at an electronic gaming machine located on a casino floor associated with the casino floor service management system, and a determination that said floor event is one of a plurality of different service floor events, receiving, from a casino floor service management system messaging gateway, data associated with an indication of the floor event occurring at the electronic gaming machine;

generating, by an application server processor of an casino floor service management system application server, a casino floor work item associated with said floor event occurring at the electronic gaming machine, wherein the casino floor service management system application server services, via the casino floor service management system messaging gateway, the casino floor service management system associated with the casino floor, and further concurrently services, via another casino floor service management system messaging gateway, another casino floor service management system associated with another casino floor;

updating, by the application server processor of the casino floor service management system application server, a backlog including a plurality of casino floor work items to include the generated casino floor work item and any association of a selected casino floor work item with a system user associated with one of a plurality of mobile devices;

after updating the backlog, causing, by the application server processor of the casino floor service management system application server, the automatic transmission of data associated with the updated backlog to each of the plurality of mobile devices, wherein each of the plurality of mobile devices is to automatically display the updated backlog of casino floor work items available to be selected independent of any inputs received via any of the plurality of mobile devices to access the updated backlog; and responsive to receiving, from the mobile device associated with the system user associated with the selected casino floor work item, casino floor work item context information comprising an image associated with the selected casino floor work item, updating the selected casino floor work item to include the casino floor work item context information.

16. The method of claim 15, further comprising causing no transmission of data associated with the indication of said floor event to the application server responsive to said floor event not being one of the plurality of different service floor events.

17. The method of claim 15, further comprising receiving data associated with an indication that the selected casino floor work item has been resolved.

18. The method of claim 17, further comprising further updating, by the application server processor of the casino floor service management system application server, the backlog to indicate that the selected casino floor work item has been resolved.

* * * * *